US009687726B2

(12) United States Patent
Lyter et al.

(10) Patent No.: US 9,687,726 B2
(45) Date of Patent: Jun. 27, 2017

(54) BOWLING PIN SETTING SYSTEMS AND METHODS WITH RECONFIGURABLE PINSETTING ARRAY

(71) Applicants: Tod S. Lyter, Yarmouth, ME (US); Clarence Leighton, Minot, ME (US); Richard Arsenault, Minot, ME (US)

(72) Inventors: Tod S. Lyter, Yarmouth, ME (US); Clarence Leighton, Minot, ME (US); Richard Arsenault, Minot, ME (US)

(73) Assignee: Tod S. Lyter, Yarmouth, ME (US)

( * ) Notice: Subject to any disclaimer, the term of this patent is extended or adjusted under 35 U.S.C. 154(b) by 0 days.

(21) Appl. No.: 14/821,552

(22) Filed: Aug. 7, 2015

(65) Prior Publication Data

US 2016/0038825 A1 Feb. 11, 2016

Related U.S. Application Data

(60) Provisional application No. 62/034,544, filed on Aug. 7, 2014.

(51) Int. Cl.
*A63D 5/08* (2006.01)

(52) U.S. Cl.
CPC ..... *A63D 5/08* (2013.01)

(58) Field of Classification Search
CPC ..... A63D 5/08
USPC ..... 473/73, 89, 90, 91, 94, 95, 97
See application file for complete search history.

(56) References Cited

U.S. PATENT DOCUMENTS

| | | | | |
|---|---|---|---|---|
| 1,297,951 A * | 3/1919 | Wheeler | ..... | A63D 5/08 473/90 |
| 1,597,973 A | 8/1926 | Hedenskoog | | |
| 2,208,605 A | 7/1940 | Schmidt | | |
| 2,550,919 A | 5/1951 | Frye | | |
| 2,716,549 A * | 8/1955 | Anderson | ..... | A63D 5/08 254/124 |
| 2,757,000 A | 7/1956 | Dowd et al. | | |

(Continued)

FOREIGN PATENT DOCUMENTS

| | | | | |
|---|---|---|---|---|
| DE | 1703684 A1 * | 2/1972 | ..... | A63D 5/04 |
| DE | 1703889 A1 * | 2/1972 | ..... | A63D 5/08 |

OTHER PUBLICATIONS

United States Patent & Trademark Office, International Search Report and Written Opinion,PCT/ISA/220, Application No. PCT/US2015/044344, Feb. 2, 2016, U.S. Patent & Trademark Office, Alexandria, VA.

*Primary Examiner* — William Pierce
(74) *Attorney, Agent, or Firm* — Pierce Atwood LLP; Kevin M. Farrell; David J. Wilson

(57) ABSTRACT

A bowling pin setting system with a reconfigurable array of bowling pin retention mechanisms with a contracted configuration with two rows of five pin retention mechanisms and an expanded configuration wherein the pin retention mechanisms are disposed in an equilateral triangle. The array of pin retention mechanisms can be movable, such as by operation of a gantry or pivotable arms, between a pin setting position above a pin deck and a retracted position removed from above the pin deck. A bowling pin assembly and loading system with a pivoting magazine and at least one pin loading magazine can receive bowling pins from the pin deck, assemble the pins into an organized format, and load them into the array of pin retention mechanisms.

3 Claims, 24 Drawing Sheets

(56) References Cited

U.S. PATENT DOCUMENTS

| | | | | | |
|---|---|---|---|---|---|
| 2,932,512 | A | * | 4/1960 | Patterson | A63D 5/08 473/94 |
| 2,967,708 | A | * | 1/1961 | Huck | A63D 5/08 198/533 |
| 3,132,863 | A | | 5/1964 | Congelli | |
| 3,307,847 | A | | 3/1967 | Kostopoulos et al. | |
| 5,039,095 | A | * | 8/1991 | Buckley | A63D 5/08 473/102 |
| 5,569,092 | A | | 10/1996 | Rochefort | |
| 5,616,084 | A | | 4/1997 | Heddon et al. | |
| 6,027,411 | A | | 2/2000 | Huhne | |
| 6,524,192 | B1 | | 2/2003 | Tsujita et al. | |
| 2005/0288115 | A1 | | 12/2005 | Popielarz et al. | |

* cited by examiner

BOWLING PIN SETTING SYSTEMS AND METHODS WITH RECONFIGURABLE PINSETTING ARRAY

FIELD OF THE INVENTION

The present invention relates generally to bowling. Stated more particularly, disclosed and protected herein is a bowling pin setting system with a reconfigurable bowling pin setting array of pin retention mechanisms with a contracted configuration wherein at least some of the pin retention mechanisms are disposed in proximity to one another and an expanded configuration wherein the pin retention mechanisms are disposed in a dispensing configuration. Further disclosed and protected is a bowling pin setting system with an array of bowling pin retention mechanisms that is movable from a pin setting position wherein the array of pin retention mechanisms is disposed in a space above a pin deck and a retracted position wherein the array of pin retention mechanisms is removed from the space above the pin deck.

BACKGROUND OF THE INVENTION

Early forms of bowling can be traced back to ancient Egypt and the Roman Empire. Indeed, evidence of bowling has been dated to 3,000 to 5,000 years ago and earlier. In one early game, stone objects were tossed as close as possible to other stone objects. Popular with Roman soldiers, this game evolved into what is now called bocce, or outdoor bowling. Tossing or rolling objects, such as balls made of corn husks wrapped in leather or another material, to knock down other objects similarly has very early origins. However, the first standardized rules for pin bowling were not developed until the late 1800's.

Modern bowling is dominated by tenpin bowling, duckpin bowling, and candlepin bowling. In each, ten pins are set up, and the players roll balls down a wooden or synthetic pathway or lane to knock down as many pins as possible. While tenpin and candlepin bowling differ in pin shape and rules, each style of bowling uses the same pin configuration and the same pin numbering system. In each, the bowling pin rack consists of ten pins arranged in an equilateral triangle with a first row formed by the 1 or head pin, a second row formed by the 2 and 3 pins, a third row formed by the 4, 5, and 6 pins, and a fourth row formed by the 7, 8, 9, and 10 pins.

When the bowling pins are properly arranged, the pin positions and relative locations are precise and consistent. The center-to-center equilateral triangle has 36-inch sides such that the distance from the center of the head pin to the centers of each of the 7 and 10 pins is 36 inches and the distance between the centers of the 7 and 10 pins is likewise 36 inches. Each pin is 12 inches from each adjacent pin. Pins aligned one directly behind the other, such as the 2 and 8 pins, the 3 and 9 pins, and the 1 and 5 pins, are spaced 20.75 inches apart. The distances from the back row of pins to the back of the lane and from the 7 and 10 pins to the gutters are similarly exact.

Consistent and precise positioning of the pins at setup is critical to bowling. For instance, a well-placed ball striking between the head pin and the 2 or 3 pin will produce a chain reaction of collisions between the ball and the pins and between pins and their surroundings that may knock down all ten pins to produce a strike if on the first ball of the frame.

If the pins are incorrectly set, chain reactions will be upset and consistent and reliable results from even well-placed impacts cannot be achieved.

In the early days of organized bowling, pins were manually set to their correct position by a pinsetter, or pinspotter, who also cleared fallen pins as appropriate and even returned bowling balls to players. Since the work was low-pay, typically part-time, and demanding manual labor, it was often done by teenage and even younger boys. Thus, the term "pinboy" came to be used as another name for the job.

When pins were set by pinboys, the area above the pin deck was left open, which was advantageous for a number of reasons. For instance, bowling pins and balls will often undergo violent collisions, which can lead to pins and balls bouncing in the air from the deck. With open space above the pin deck, the pins and balls can move and land naturally without outside influence. Moreover, the open area above the pin deck contributed to a feeling of free and uncluttered space for the bowler, easier exposure to ambient lighting, and improved viewing of the bowling action, particularly from areas above and around the specific bowling lane in use.

However, the manual setting of bowling pins is inherently subject to human error and individual human pin setting tendencies. Incorrectly set pins detract from proper and expected collision characteristics and chain reactions, and differences between pinsetters mean that a bowler in a given lane might have different bowling experiences and results. Still further, manual pinsetting can be time consuming thereby leading to waiting for bowlers and reduced revenue for bowling alleys with each string of bowling requiring longer time periods. Worst of all, heavy bowling balls sending the pins flying through the air would frequently injure the waiting pinboys. Good pinboys were often in short supply, and pinboys soon demanded higher wages for their hazardous work.

In response to the foregoing shortcomings and other factors, a number of inventors set about designing machines to mechanize pin setting. For instance, with U.S. Pat. No. 1,597,973, Ernest Kedenskoog disclosed a Pin Spotter with a pin setter frame having a plurality of pivoted pockets that raised and lowered vertically over the bowling alley to deposit pins on the bowling alley in a predetermined pattern. Gottfried Schmidt, himself a bowler and machinery designer, was awarded a number of patents, including U.S. Pat. No. 2,208,605 for a Bowling Pin Setting Apparatus, which issued on Jul. 23, 1940 based on an application filed in 1936. That mechanical pinsetter became the AMF (American Machine & Foundry Company) pinsetter, the standard for the industry. With these and other developments, the pinboy was largely relegated to history.

The mechanical pinsetters of Kedenskoog, Schmidt, and others achieved their fundamental goal: pinboys and manual pinsetting were replaced with mechanized pinsetting systems that could function continuously, consistently, and with reliable speed. While a number of patents relating to mechanical pinsetters followed over the ensuing decades, there has been remarkably little development in the field over the past several decades. The essential functionality of the mechanical pinsetter has remained unchanged; a pin setting frame or table hovers above the pin deck, often concealed from the bowler by a curtain or false wall. The pin setting table lowers into position to dispense and, as necessary, to lift pins between ball rolls. Where pins remain standing after a given shot in ten-pin bowling, the pin setting table engages and lifts the remaining pins to permit a clearing of the pin deck by a sweeper mechanism.

In the mechanical pinsetters of the current state of the art, a hulking, complicated mechanism must occupy the space just above the pin deck, leaving only a relatively shallow location for the pins to stand. Gone are the open areas of the pinboy days, sacrificed in favor of mechanization. Consequently, pins and balls bouncing in the air from the deck can strike the pinsetting table, thereby altering the natural trajectory of the projectile and potentially damaging the machine. The area above the pin deck necessarily takes on a cluttered feel with the standing pins exposed only through the visual slot between the pin deck and the pinsetting table or the curtain or false wall concealing the same. The pins enjoy little exposure to ambient light and must be separately illuminated, if at all. Still further, observers, particularly those not directly in line with the active alley, have their views of the bowling action obscured.

With a knowledge of the foregoing, the present inventors appreciated that there is a need in the art of bowling for a major shift in the systems and methods of pinsetting. Rather than continuing to labor under the premise that the pinsetting table must occupy and overwhelm the volume above the pin deck and that the pins must be arranged in the pinsetter in their final, triangular configuration, it would be desirable to provide a mechanized pinsetting system and method that leaves the volume above the pin deck open as in the era of pinboys while providing for consistent, accurate, and rapid pinsetting as enabled by mechanization.

SUMMARY OF THE INVENTION

In view of the state of the art and the limitations and deficiencies of current mechanized pinsetters as summarized above, the present inventors set forth with the object of providing a mechanized pin setting system that exhibits consistent, accurate, and rapid setting of bowling pins while, in certain embodiments, leaving the space above the pin deck open during bowling play.

In particular embodiments of the bowling system, an object of the invention is to provide a bowling pin setting system with a reconfigurable pin setting array wherein bowling pins to be set are adjustable between a first, compact or juxtaposed configuration and a second, spread configuration of final pin setting positions.

An underlying goal of particular embodiments of the invention is to provide a bowling pin setting system that recreates the bowling action and perceptions that bowlers experienced when pinboys were manually setting and resetting the pins.

A further object of manifestations of the invention is to provide a mechanized pin setting system that limits or eliminates the obstructions to the natural flight of struck bowling pins and flying bowling balls thereby permitting natural play much as in the days of manual pin setting.

A related object of the invention in certain embodiments is to provide a mechanized pin setting system that minimizes damage to the system from flying bowling balls and pins.

Another object of embodiments of the invention is to provide a mechanized pin setting system that permits relatively unobstructed views of the bowling action, even by those not in or even at the same level as the active lane and that permits illumination of the bowling pins and the pin deck in general by ambient lighting.

A particular object of embodiments of the invention is to provide a pin setting system with a reconfigurable pin setting array that can quickly organize ten bowling pins, set them down in a perfect equilateral triangle, and quickly exit the field of play.

In certain embodiments of the invention, a further object is to provide a bowling pin setting and pin clearing system wherein toppled pins, or deadwood, can be cleared without a need for a sweeper but instead with a rapid and consistent pivoting deck structure that rapidly moves pins from the pin deck to a pin pit.

Further embodiments of the invention have the object of providing a bowling alley system wherein ventilation is automatically and naturally provided to the area below the alley while permitting ornamental and, potentially, functional lighting effects to be achieved from below the plane of the bowling alley surface.

Still another object of embodiments of the invention is to provide a bowling alley system wherein the pin pit is substantially devoid of obstacles to pin movement and flow and that effectively improves pin movement in the pit thereby to minimize jamming of the system.

Particular embodiments of the invention have the still further object of rapidly assembling and repositioning pins from horizontal to vertical positions, including for assembly into pin magazines and subsequent supply to the pin setting system.

Yet another object of embodiments of the invention is to provide a bowling lane system that enables rapid lane construction with reduced fire risks.

Embodiments of the bowling system have the still further object of enabling selective side railing of the bowling alley thereby to prevent gutter balls.

These and further objects and advantages of embodiments of the invention will become obvious not only to one who reviews the present specification but also to one who has an opportunity to make use of an embodiment of the bowling systems and methods disclosed herein. It will be appreciated, however, that, although the accomplishment of each of the foregoing objects in a single embodiment of the invention may be possible and indeed preferred, not all embodiments will seek or need to accomplish each and every potential object and advantage. Nonetheless, all such embodiments should be considered within the scope of the invention.

In carrying forth certain objects of the invention, an embodiment of a bowling pin setting system as taught herein can have a reconfigurable array of bowling pin retention mechanisms for setting bowling pins on a pin deck of a bowling alley. The pin setting system has a plurality of bowling pin retention mechanisms, and each bowling pin retention mechanism can selectively retain and release a bowling pin. The bowling pin retention mechanisms are disposed in an array of bowling pin retention mechanisms with a contracted configuration wherein the pin retention mechanisms are disposed in given positions relative to one another and an expanded configuration wherein at least some of the pin retention mechanisms are moved away from one another.

The expanded configuration can be a dispensing configuration in which the array of bowling pin retention mechanisms are disposed in an equilateral triangle formation. There can be ten bowling pin retention mechanisms. The contracted configuration can have two rows of five pin retention mechanisms.

Where the expanded configuration takes the form of an equilateral triangle formation for dispensing bowling pins in a triangular configuration, it can have a first row formed by a number 1 pin retained and released by a number 1 pin retention mechanism, a second row formed by number 2 and 3 pins retained and released by number 2 and 3 pin retention mechanisms, a third row formed by number 4, 5, and 6 pins retained by number 4, 5, and 6 pin retention mechanisms, and a fourth row formed by 7, 8, 9, and 10 pins retained by number 7, 8, 9, and 10 pin retention mechanisms. In such constructions, the contracted configuration can have an anterior row of pin retention mechanisms and a posterior row of pin retention mechanisms. The anterior row can have the 4, 2, 1, 3, and 6 pin retention mechanisms in order, and the posterior row can have the 7, 8, 5, 9, and 10 pin retention mechanisms in order. The array of pin retention mechanisms can be reconfigured from the contracted configuration to the expanded configuration with the 1 pin retention mechanism 24 moving anteriorly, the 2 and 3 pin retention mechanisms 24 moving laterally outward, the 4 and 6 pin retention mechanisms moving posteriorly and outwardly, the 5 pin retention mechanism 24 moving anteriorly, and the 7, 8, 9, and 10 pin retention mechanisms 24 moving laterally outward.

Each pin retention mechanism can have at least one retaining member, such as a retaining finger. The retaining finger can be selectively pivoted between a retaining position wherein a bowling pin can be retained and a release position where a retained bowling pin is released.

It is further contemplated that the array of pin retention mechanisms can be movable from a pin setting position wherein the pin setting array is disposed in a space above the pin deck and a retracted position wherein the array of pin retention mechanisms is at least partially removed from the space above the pin deck. More particularly, it is possible for the pin setting position to comprise an anterior position and for the retracted position to comprise a posterior position in which the array of pin retention mechanisms is substantially entirely removed from the space above the pin deck.

The pin deck can be considered to have an anterior end and a posterior end. A divider can be disposed adjacent to the posterior end of the pin deck, and the array of pin retention mechanisms can be disposed behind the divider when in a posterior or retracted position.

Movement of the array of pin retention mechanisms can be accomplished, for instance, by having the array of pin retention mechanisms retained by a gantry that permits longitudinal adjustment of the array of pin retention mechanisms between the pin setting position and the retracted position. Further, the array of pin retention mechanisms can be raised and lowered relative to the pin deck, such as by being retained by a platform or framework that is supported by the gantry and by being capable of being raised and lowered relative to the platform. In other embodiments, the array of pin retention mechanisms can be retained by a pivoting mechanism, such as first and second pivotable arms, that permits pivoting adjustment of the array of pin retention mechanisms between the pin setting position and the retracted position.

The bowling pin setting system can further include a bowling pin assembly and loading system for receiving bowling pins from the pin deck, assembling the pins into an organized format, and loading them into the array of pin retention mechanisms. The bowling pin assembly and loading system can take the form of a rotational turntable, a conveyor, a pivoting magazine, which may alternatively be referred to as an assembly magazine, that receives bowling pins from the turntable through the conveyor, and at least one pin loading magazine that receives bowling pins from the pivoting magazine. The pivoting magazine can receive bowling pins with the bowling pins and the pivoting magazine in a generally horizontal orientation, and a lifting mechanism can be operative to lift the pivoting magazine and bowling pins retained by the pivoting magazine to a generally vertical orientation. Still further, a push drive mechanism can operate to slide bowling pins from the pivoting magazine and into the at least one pin loading magazine.

In certain embodiments, there can be first and second pin loading magazines. The array of pin retention mechanisms can have a contracted configuration with two rows of five pin retention mechanisms and an expanded configuration. The first and second pin loading magazines can then be capable of aligning with two rows of five pin retention mechanisms of the array of pin retention mechanisms. With that, the pin retention mechanisms can be disposed to engage and retain bowling pins retained by the pin loading magazines.

One will appreciate that the foregoing discussion broadly outlines the more important features of the invention merely to enable a better understanding of the detailed description that follows and to instill a better appreciation of the inventors' contribution to the art. Before an embodiment of the invention is explained in detail, it must be made clear that the following details and descriptions of inventive concepts are mere examples of the many possible manifestations of the invention.

DETAILED DESCRIPTION OF PREFERRED EMBODIMENTS

Figure 1:
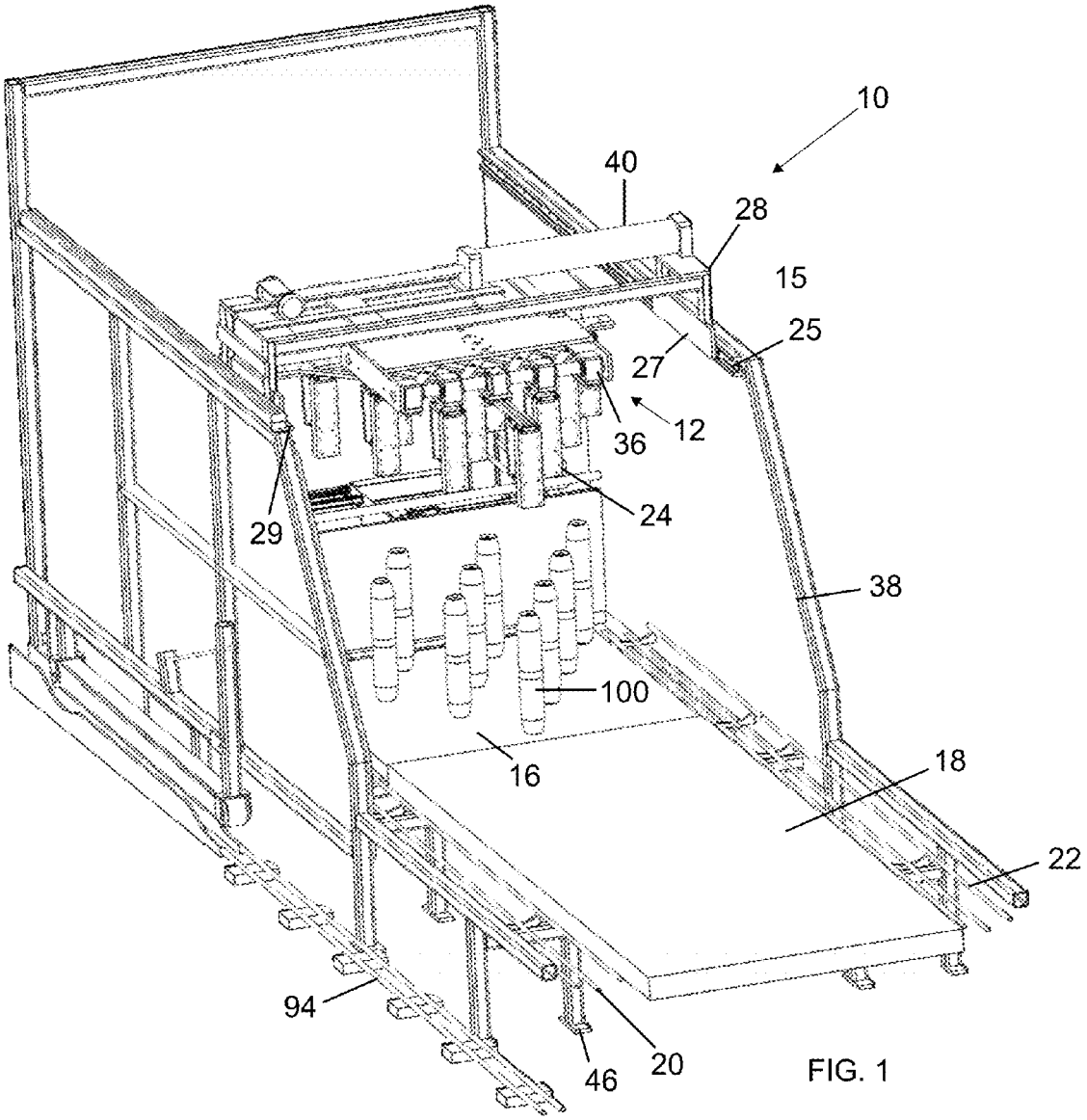
FIG. 1 is a perspective view of a bowling pin setting system as taught herein with the reconfigurable bowling pin setting array in an expanded configuration and in an anterior, raised position after the bowling pins have been set.
Figure 2:
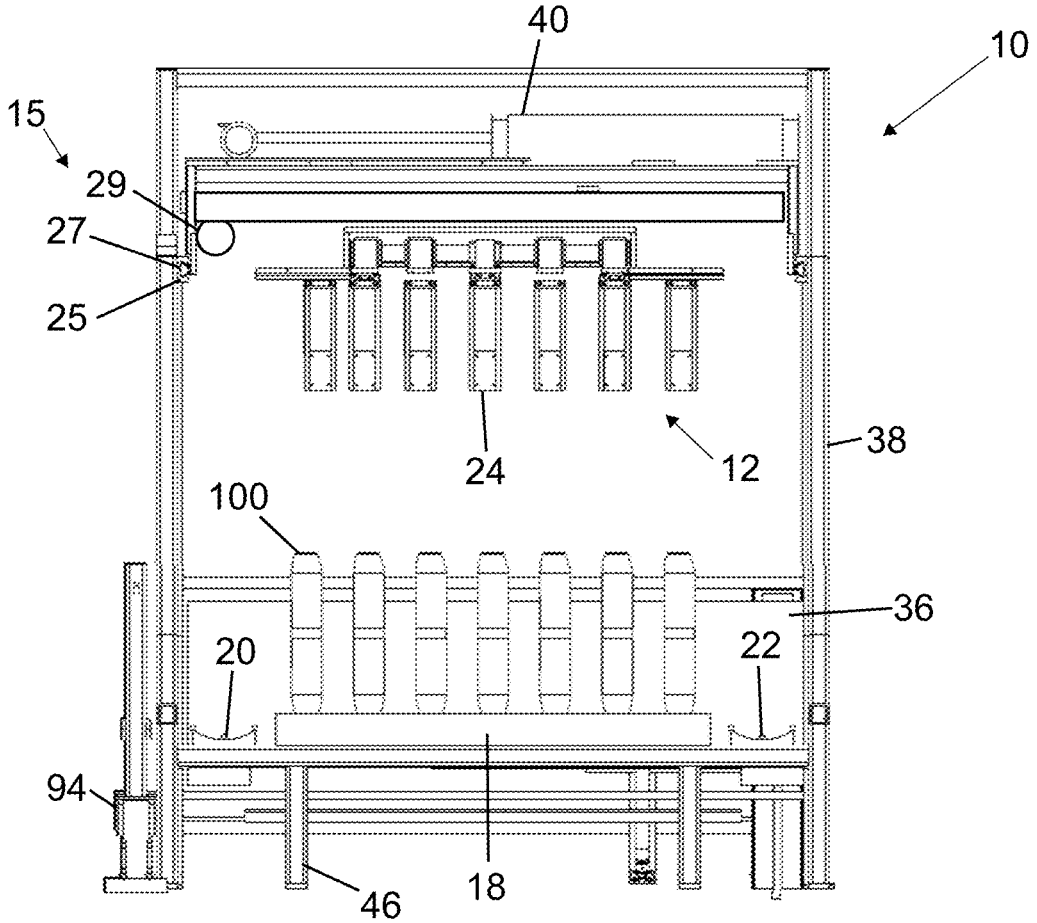
FIG. 2 is a view in front elevation of the bowling pin setting system of FIG. 1.
Figure 3:
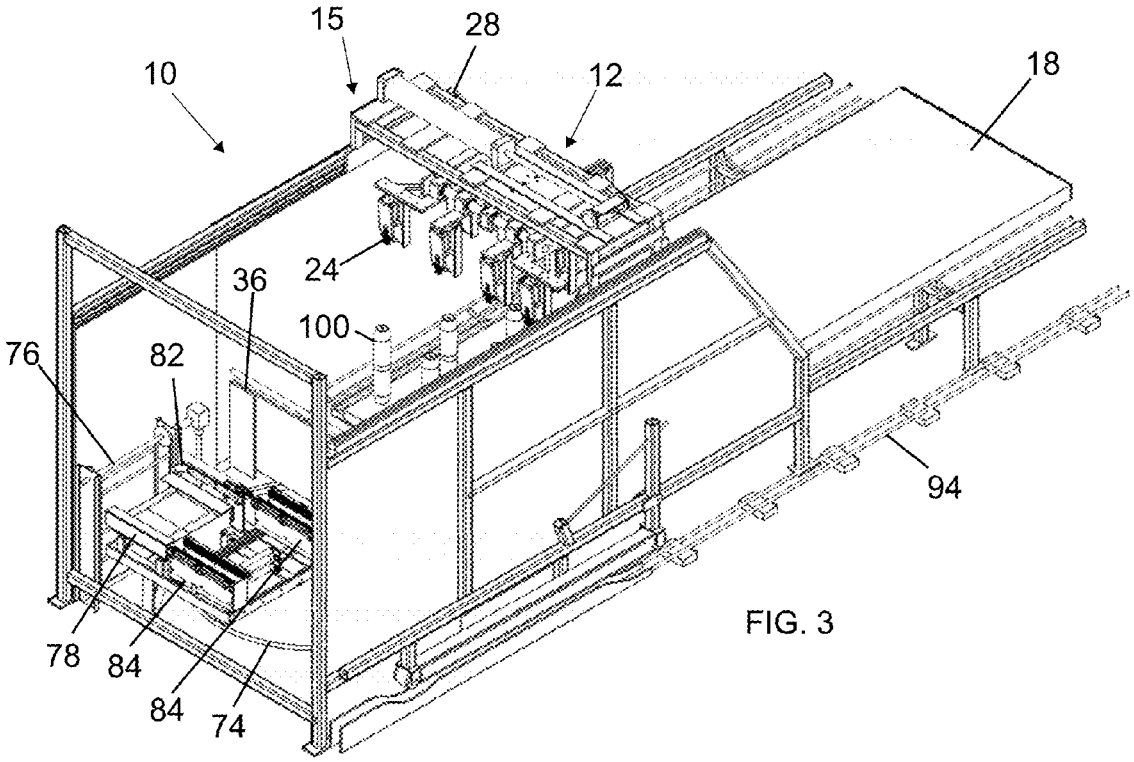
FIG. 3 is a rearward perspective view of the bowling pin setting system of FIG. 1.
Figure 4:
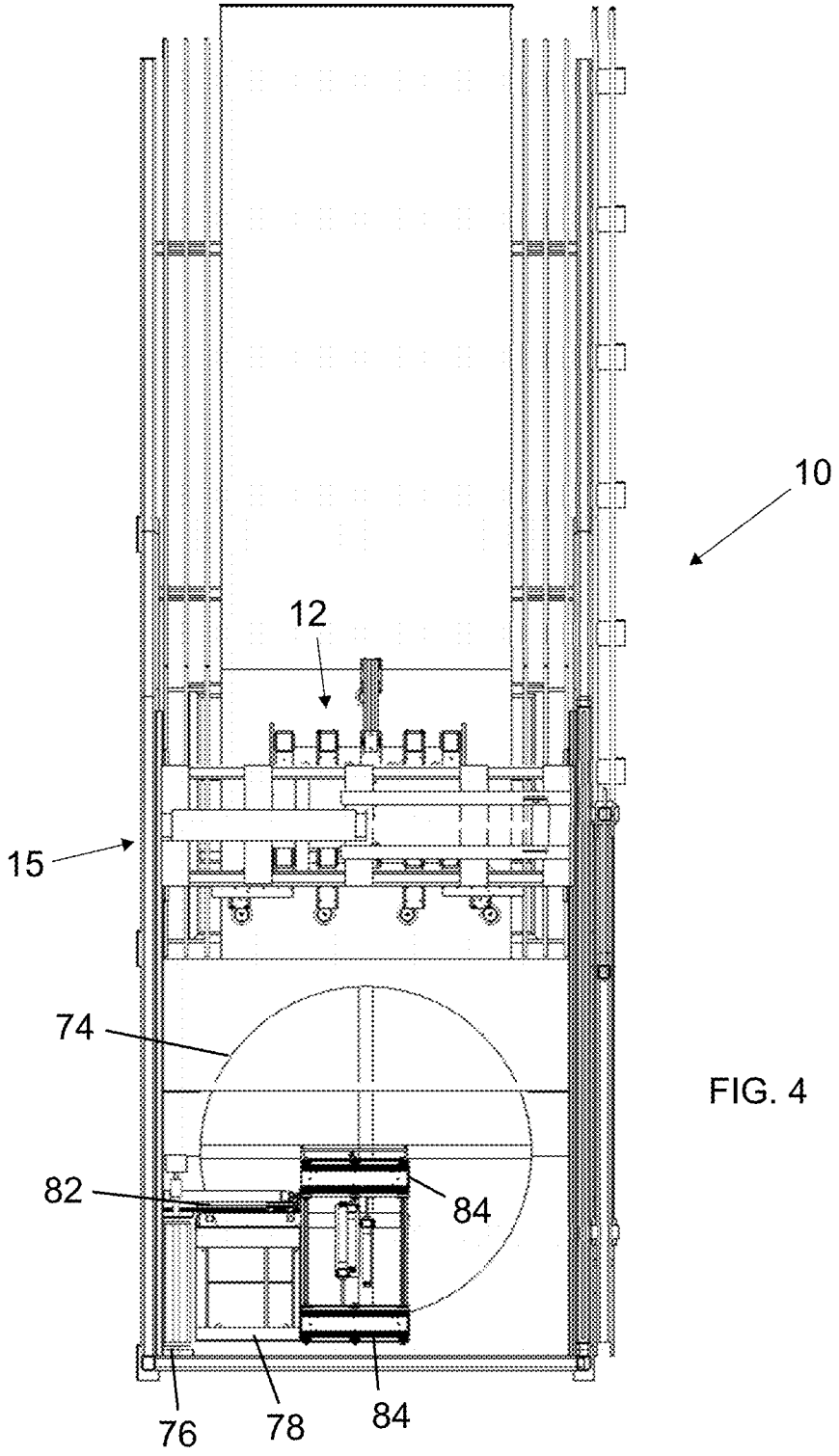
FIG. 4 is a top plan view of the bowling pin setting system of FIG. 1.

The bowling systems and methods disclosed herein, including the retractable bowling pin setting system and method with a reconfigurable pinsetting array, disclosed herein are subject to varied embodiments, each within the scope of the invention. However, to ensure that one skilled in the art will be able to understand and, in appropriate cases, practice the present invention, certain preferred embodiments of the broader invention revealed herein are described below.

Looking more particularly to the drawings, a bowling pin setting system according to the invention is indicated generally at 10 in FIGS. 1 through 5 and in a slightly alternative embodiment in FIGS. 7-10. There, the bowling pin setting system 10 is founded on a reconfigurable pin setting array 12 of pin retention mechanisms 24. In the depicted embodiments, there are ten pin retention mechanisms 24. As will be shown and described further hereinbelow, the pin retention mechanisms 24 are constructed to receive, retain, and release bowling pins 100 during a cycle or frame of bowling play. The pin setting array 12 in this manifestation of the pin setting system 10 is configured for retaining candlepin bowling pins 100, but it will be understood that the invention is not so limited. Other types of bowling pins, including ten pin bowling pins and duck pins, could be retained and set within the scope of the invention except as it might be expressly limited by the claims.

Figure 8:
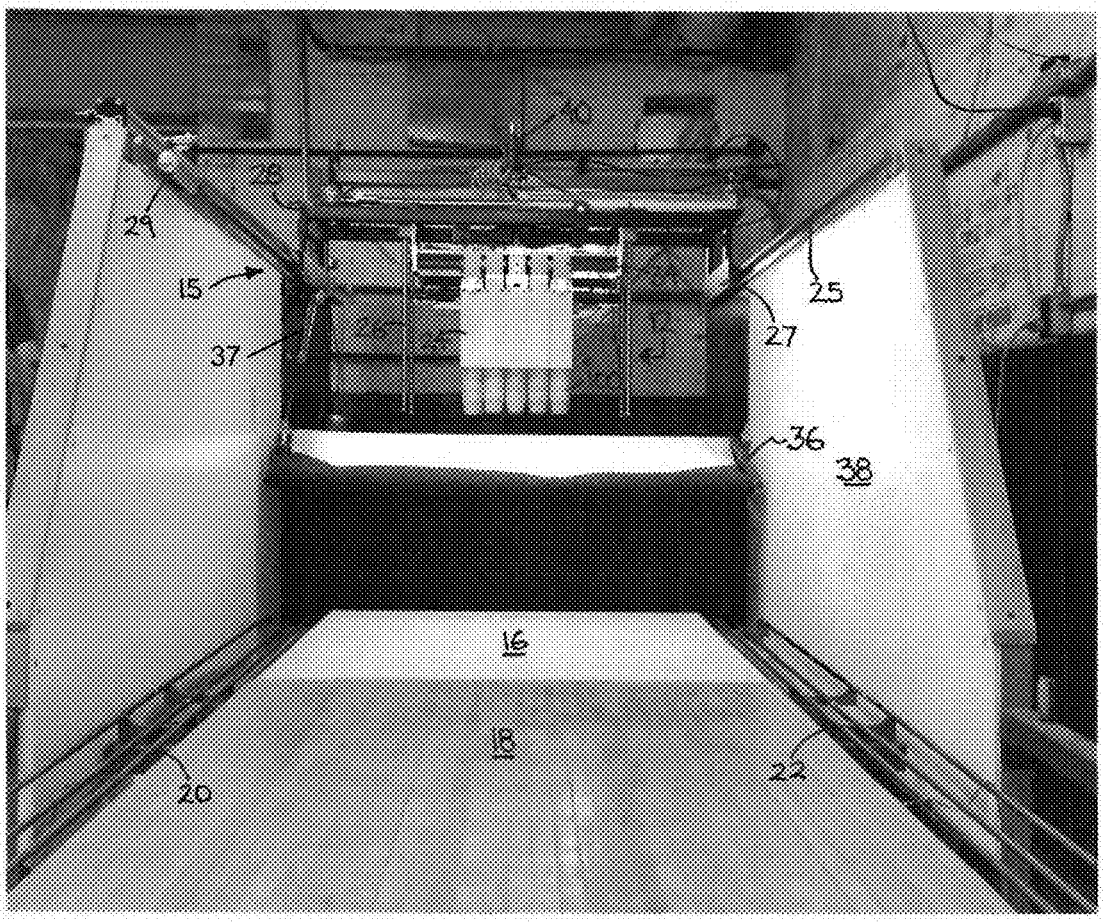
FIG. 8 is a view in front elevation of the bowling pin setting system of FIG. 7 with the reconfigurable bowling pin setting array in a contracted configuration and in a posterior, raised position.
Figure 9:
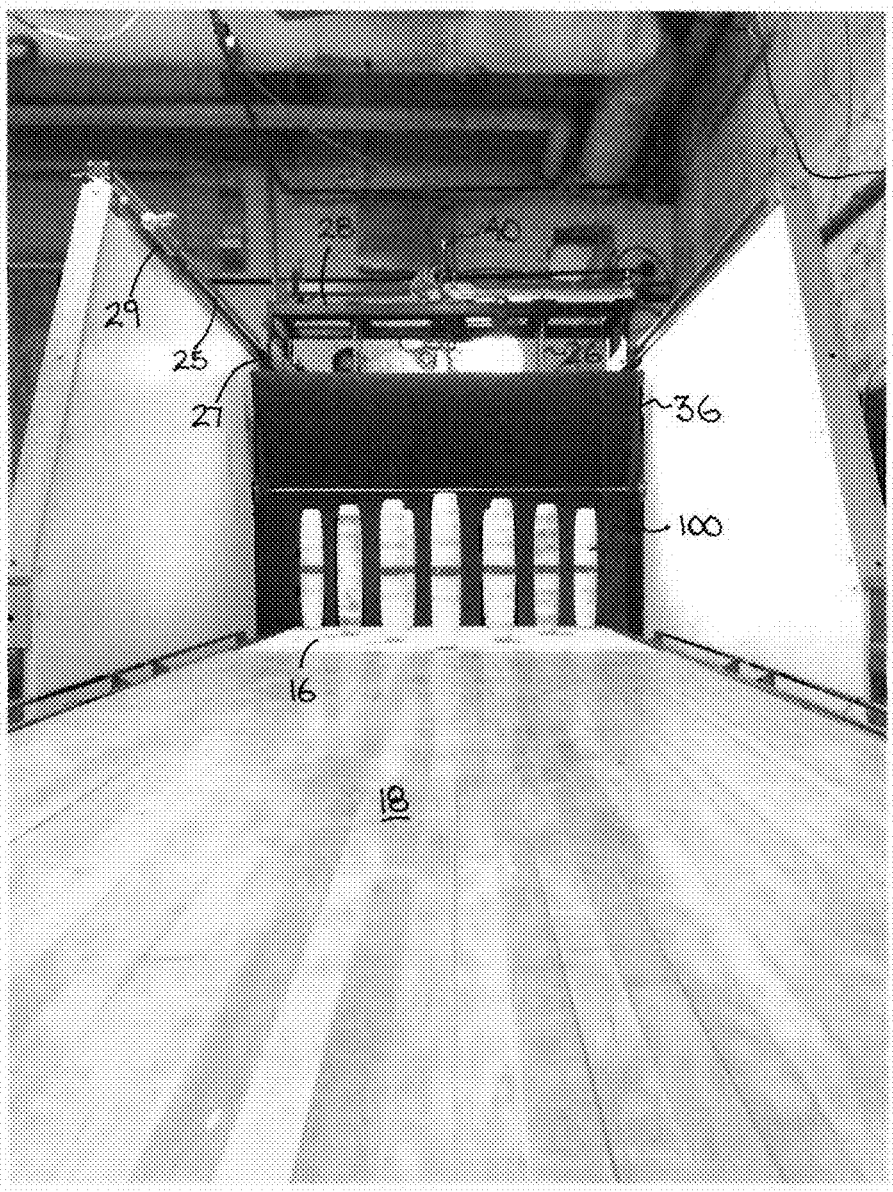
FIG. 9 is a view in front elevation of the bowling pin setting system of FIG. 5 with the reconfigurable bowling pin setting array in a posterior position behind the curtain after the bowling pins have been set.
Figure 13:
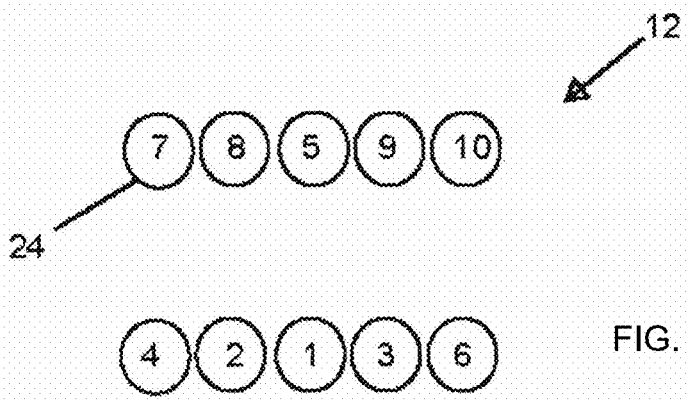
FIG. 13 is a schematic, top plan view of bowling pins in a contracted configuration pursuant to the invention.

As seen, for instance, in FIG. 8 and schematically in FIG. 13, the pin setting array 12 has a contracted configuration where the pin retention mechanisms 24 and any bowling pins 100 retained thereby are disposed in immediate proximity to one another. The contracted configuration of the pin retention mechanisms 24 and bowling pins retained thereby could vary within the scope of the invention. Here, the contracted configuration has two rows of five pin retention mechanisms 24. With the bowling pin setting system 10 assumed to have a longitudinal direction aligned with the longitudinal direction of a bowling alley 18 and a lateral direction perpendicular thereto, the rows of pin retention mechanisms 24 are aligned in a lateral direction. With that, there is an anterior row of five pin retention mechanisms 24 and a posterior row of five pin retention mechanisms 24. It will be appreciated, however, that other contracted configurations are possible and within the scope of the invention. Each pin retention mechanism 24 is dedicated to a given pin position in the final bowling pin setup.

Accordingly, the ten-pin retention mechanisms 24 can be referred to by their final pin position in the expanded configuration. In this example, the anterior row has the 4, 2, 1, 3, and 6 pin retention mechanisms 24 and pins 100 disposed in that order from left to right, and the posterior row has the 7, 8, 5, 9, and 10 pin retention mechanisms 24 and pins 100 disposed in that order from left to right.

Figure 7:
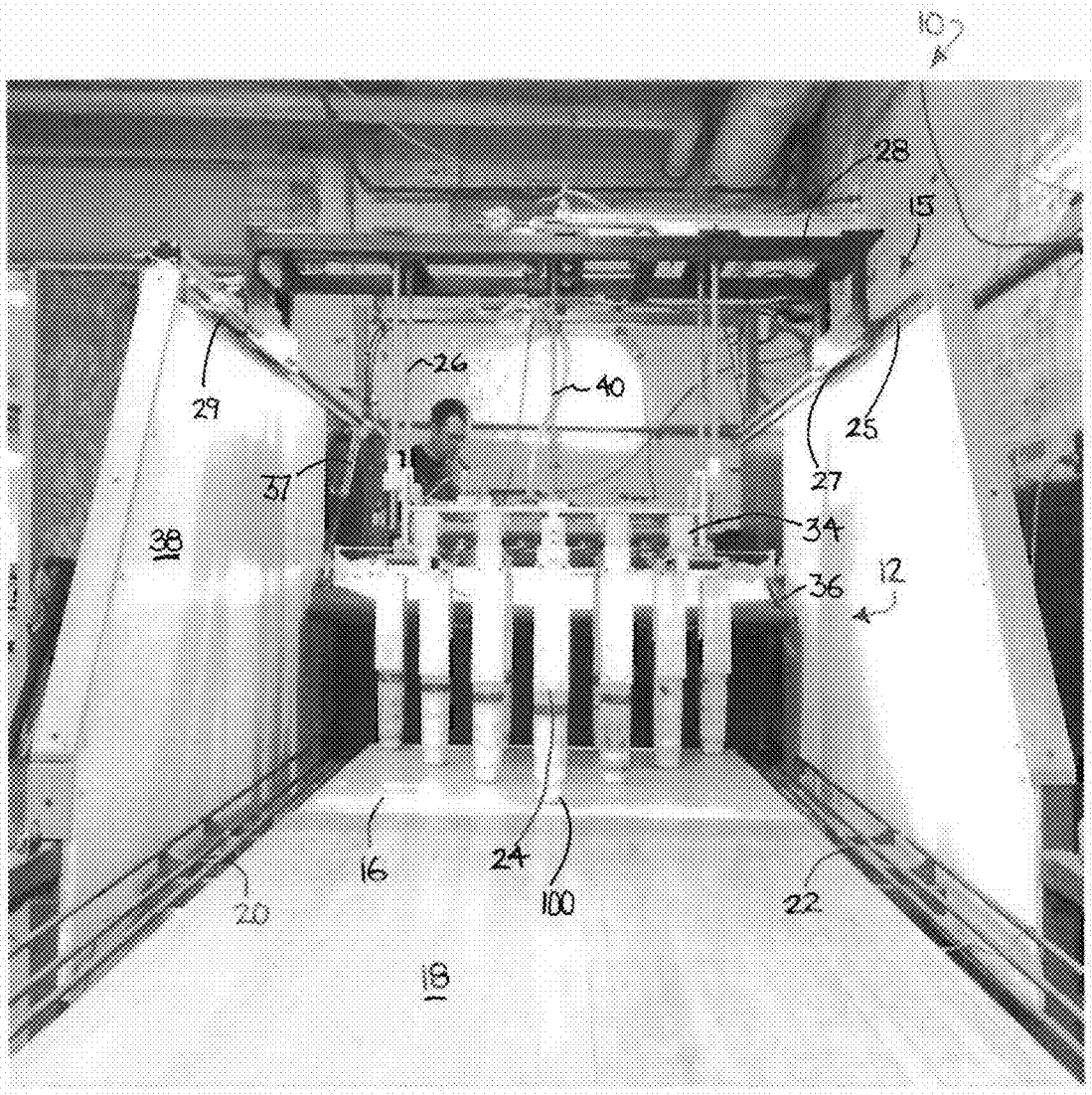
FIG. 7 is a view in front elevation of a bowling pin setting system as taught herein with the reconfigurable bowling pin setting array in an expanded configuration and in an anterior, lowered position during a setting of pins.
Figure 14:
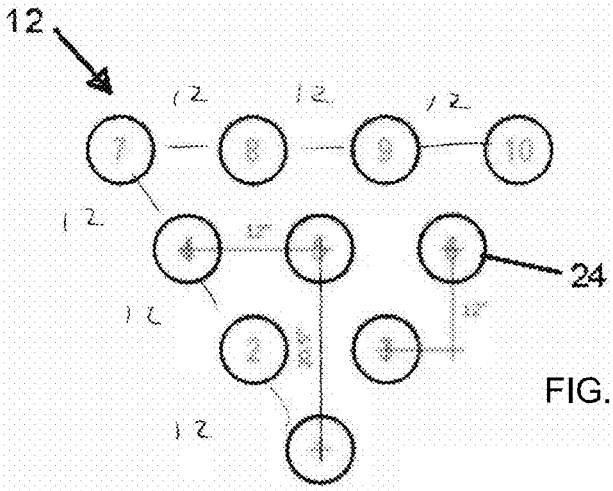
FIG. 14 is a schematic, top plan view of bowling pins in an expanded configuration pursuant to the invention.

The pin setting array 12 is reconfigurable to an expanded configuration as shown in FIGS. 1 and 7, for example, and schematically in FIG. 14. When adjusted to the expanded configuration, the pin retention mechanisms 24 correspond in location to the final dispensing configuration of the bowling pins 100. In this example, with ten pin retention mechanisms 24 configured for candlepin bowling with ten pins 100, the pin retention mechanisms 24 move from the double row, contracted configuration to an expanded, equilateral triangle configuration.

The movement patterns of the pin retention mechanisms 24 could vary widely within the scope of the invention. Absent further limitation, a contracted configuration shall mean a configuration wherein the pin retention mechanism 24 are in given relative positions, and an expanded configuration shall mean a configuration wherein one, some, or all of the pin retention mechanisms 24 are moved away from one, some, or all of the remaining pin retention mechanisms 24. As shown and described herein, the expanded configuration can be a configuration wherein one, some, or all of the pin retention mechanisms 24 are moved laterally and/or longitudinally away from one, some, or all of the remaining pin retention mechanisms 24 as configured in the contracted configuration.

In one possible example, as depicted, the pin retention mechanisms 24 of the anterior row of mechanisms 24 are automatically reconfigured to their final positions with the 1 pin retention mechanism 24 moving anteriorly, the 2 and 3 pin retention mechanisms 24 moving laterally outward, and the 4 and 6 pin retention mechanisms 24 moving posteriorly and outwardly, in any order or simultaneously. The pin retention mechanisms 24 of the posterior row are automatically reconfigured to their final pin positions with the 5 pin retention mechanism 24 moving anteriorly and the 7, 8, 9, and 10 pin retention mechanisms 24 moving laterally outward.

Movement of the pin retention mechanisms 24 between the contracted and expanded configurations could be achieved in numerous ways within the scope of the invention. By way of example, movement could be effected by hydraulics, pneumatics, gearing, or any combination thereof, or by any other mechanism or mechanisms capable of producing the desired movement. The necessary movements can be practiced in numerous different ways, and this disclosure shall merely give one or more examples of the many arrangements that are within the scope of the invention.

Figure 12:
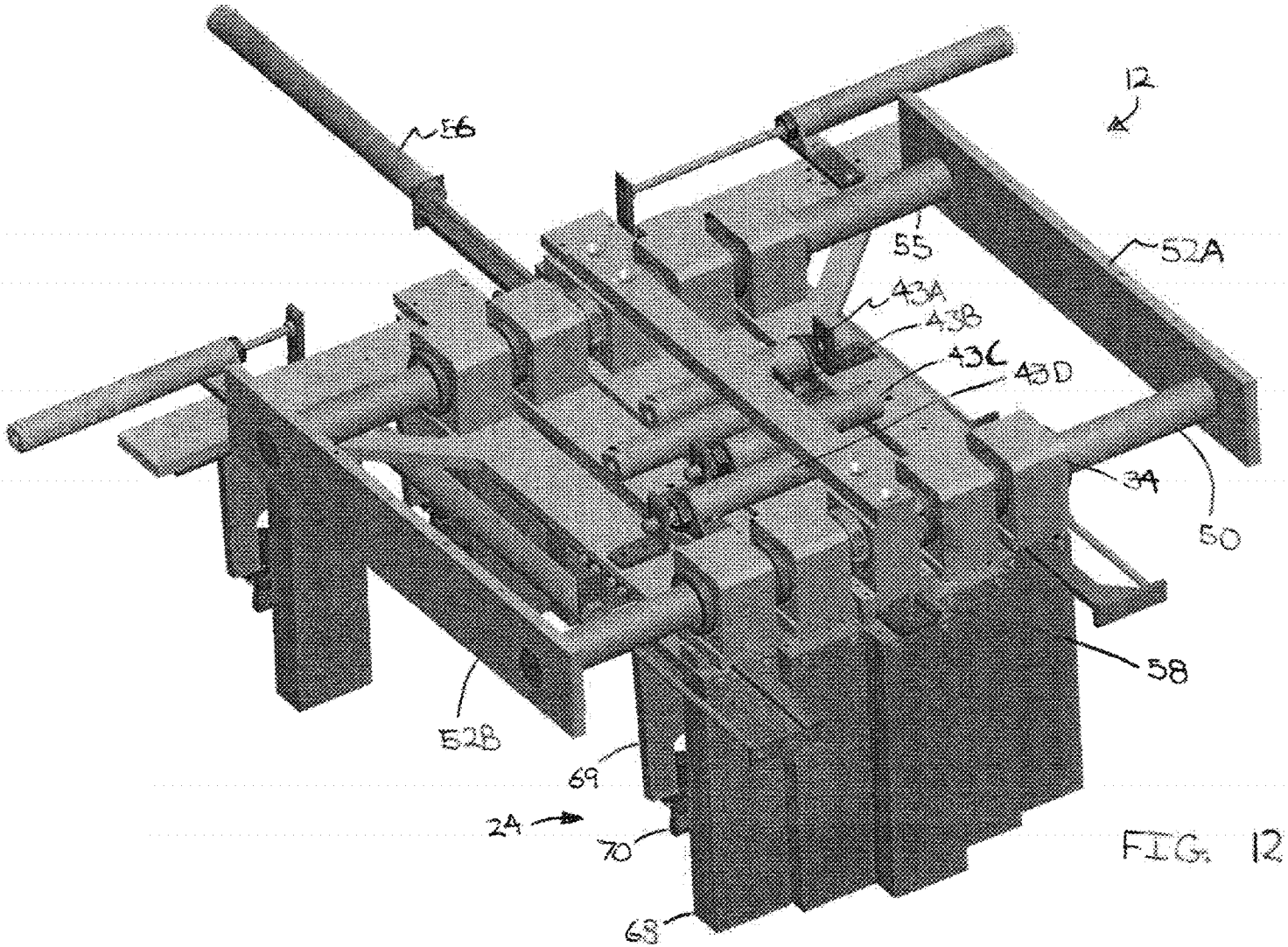
FIG. 12 is a perspective view of a bowling pin setting array according to the invention during reconfiguration.

In one presently contemplated manifestation of the invention, for example, movement of the pin retention mechanisms 24 is performed by pressurized fluid systems, which could be hydraulic or pneumatic. As seen in FIG. 12, the pressurized fluid systems include main lateral right and left pressurized cylinders 42A and 42B and pressurized cylinders 43A-43D that operate to extend and retract to produce the desired lateral movement of the pin retention mechanisms 24 between an inboard position where the rows of pin retention mechanisms 24 are disposed in immediate proximity of the contracted configuration and outboard positions where the pin retention mechanisms 24 are disposed in their final, pinsetting positions of the expanded configuration. One or more longitudinal pressurized cylinders 56 produces the necessary longitudinal movement of the pin retention mechanisms 24 of the 1, 4, and 6 pins 100. As necessary, such as with the 1 and 5 pin retention mechanisms 24, the pin retention mechanisms 24 can be longitudinally movable along one or more longitudinal guide members 58, and the longitudinal guide members 58 or the pin retention mechanisms 24 directly can be laterally movable along anterior and posterior lateral slide bars 50 and 55, which can in turn be supported by side brackets 52A and 52B. As illustrated, the pin retention members 24 can be slidable along the lateral slide bars 50 and 55 through, for example, slide blocks 34 that slidably engage the bars 50 and 55.

With this, by combined operation of the pressurized cylinders 42A, 42B, 43A-43D, and 56, the pin retention mechanisms 24 can be rapidly moved between the contracted configuration of, for example, FIG. 12 and the expanded configuration of, for example, FIG. 13. For example, to reconfigure the pin retention mechanisms 24 from the contracted to expanded configurations, the 1 and 5 pin retention mechanisms 24 can be moved anteriorly. The 2 and 3 pin retention mechanisms 24 can be moved laterally outward, the 4 and 6 mechanisms 24 can be moved laterally outward and posteriorly, and the 7, 8, 9, and 10 pin retention mechanisms 24 can be moved laterally outward. The process can be reversed to return to the contracted configuration.

Figure 5:
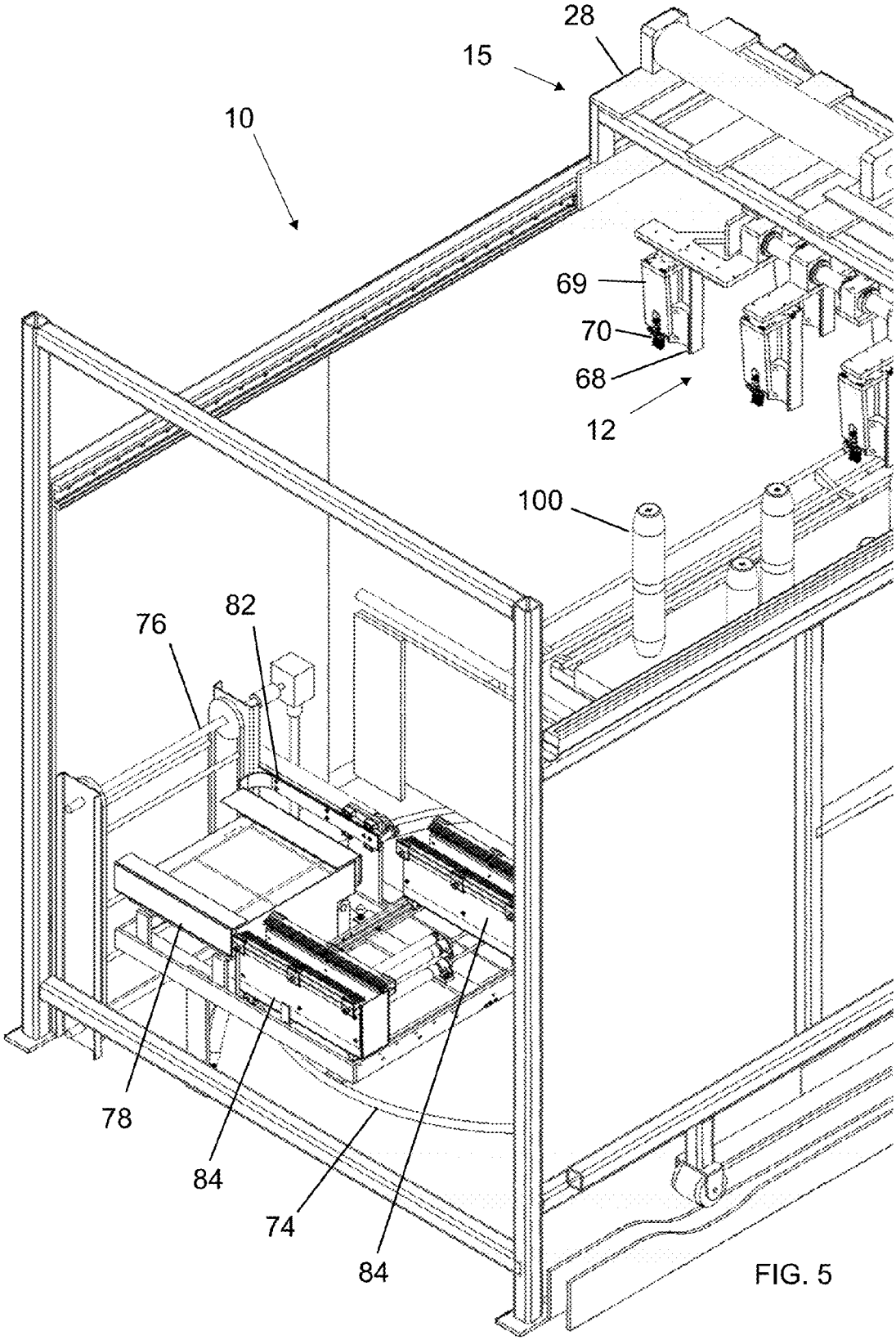
FIG. 5 is an amplified rearward perspective view of a portion of the bowling pin setting system of FIG. 1 depicting the bowling pin assembly and loading system disclosed herein.
Figure 6:
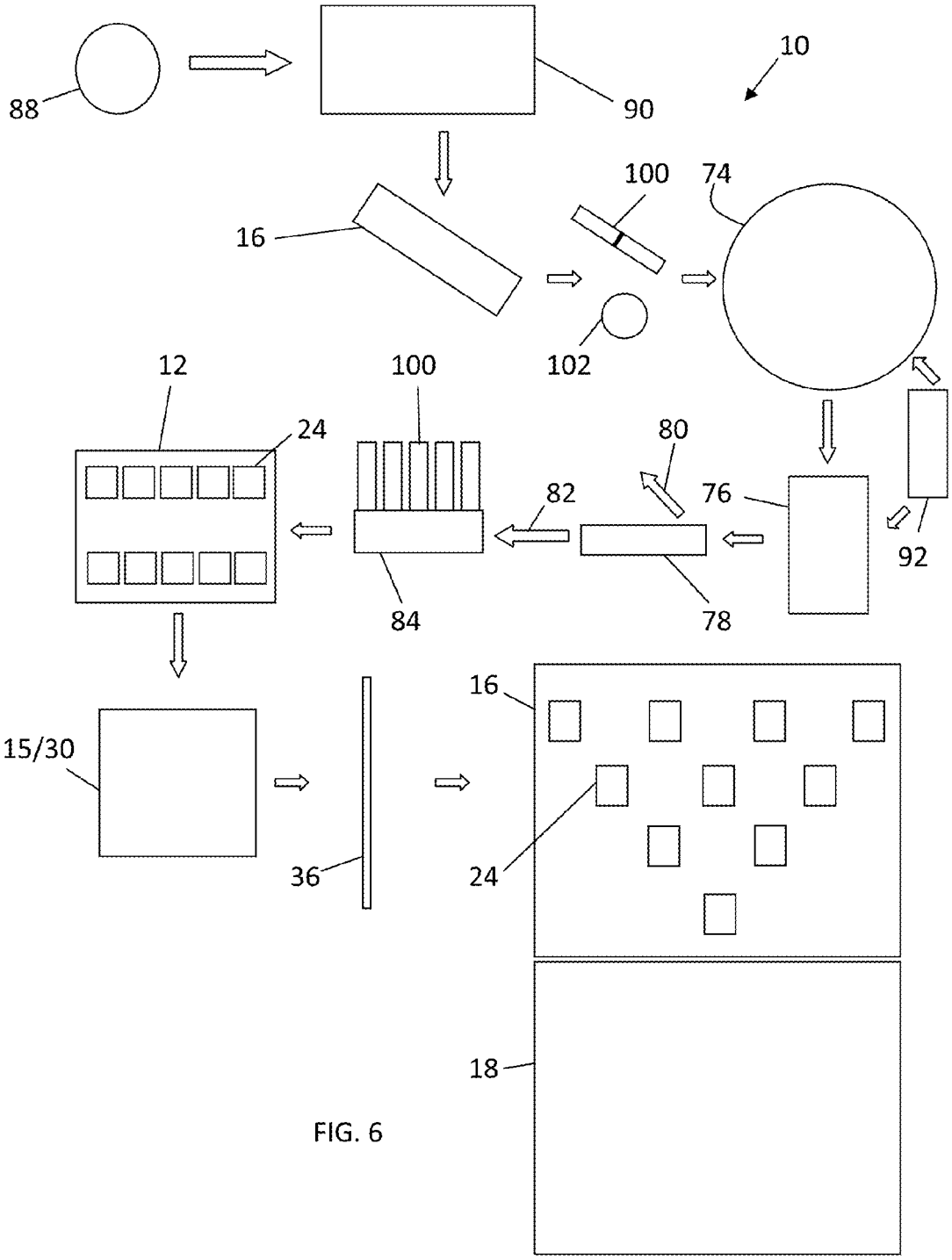
FIG. 6 is a flow chart depicting practices of bowling pin picking and placing and collecting and organizing according to the invention.
Figure 11:
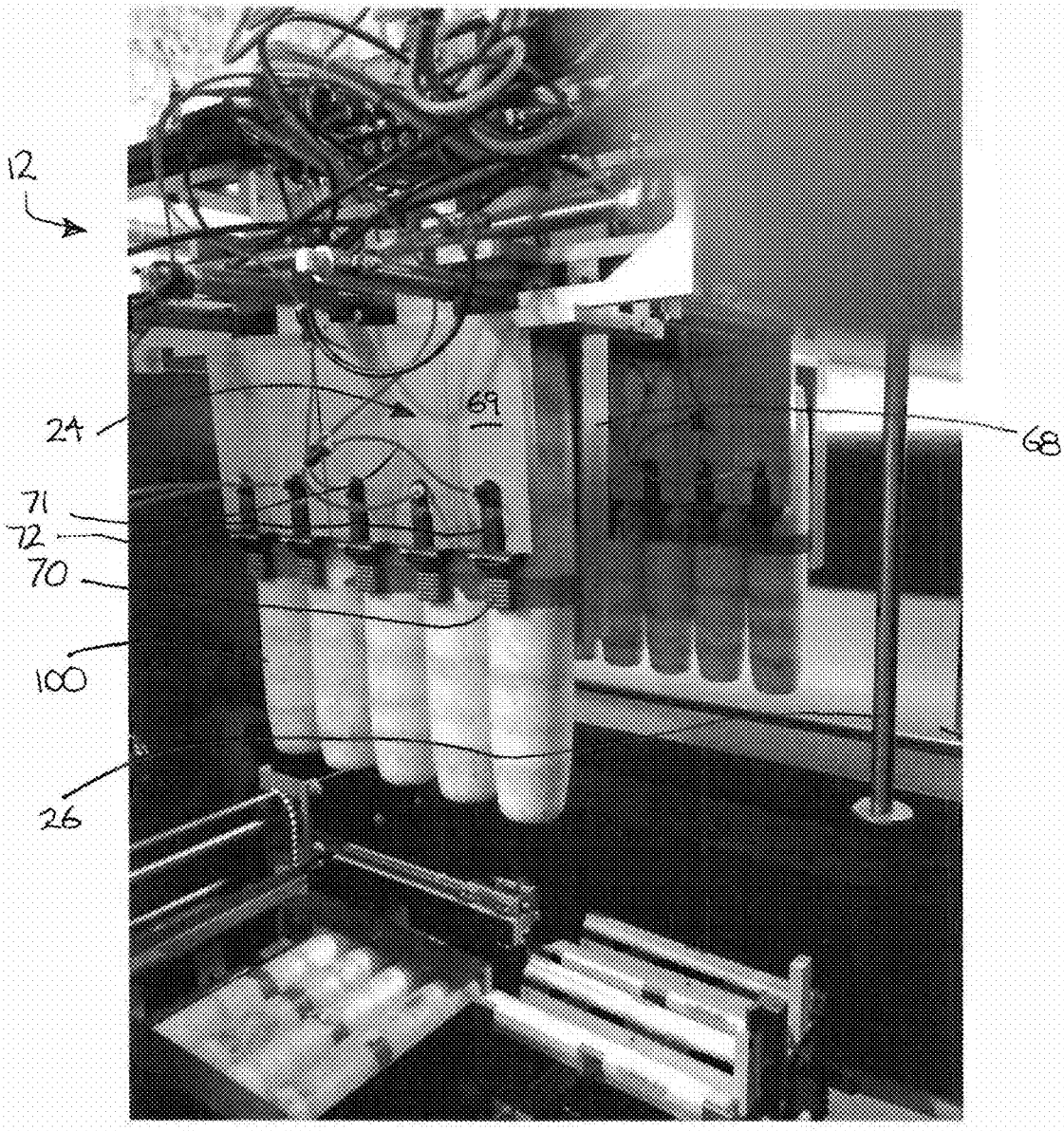
FIG. 11 is a perspective view of a bowling pin setting array embodying the invention in a contracted configuration.

Each pin retention mechanism 24 is capable of selectively retaining a bowling pin 100 as is illustrated, for example, in FIGS. 5 and 11 and releasing the pin 100 as desired, such as once the pin setting array 12 is in the expanded configuration. This too could be done in numerous different ways, including any of the many methods already disclosed or any method that might in the future be developed. In this depicted example, where the pin retention mechanisms 24 retain candlepin bowling pins 100, each pin retention mechanism 24 selectively grips and retains a bowling pin 100 by the combined effects of opposed retaining members 68 and 69 that matingly receive the pin 100 and a retaining finger 70 operative by a pivoting mechanisms 72 that could also be actuated by pressurized fluid. More particularly, the retaining finger 70 in this embodiment is selectively pivoted into and out of restraining engagement with the pin 100 by the application of air pressure from an air line 71. Here, the retaining finger 70 has a plurality of lateral gripping surfaces spaced longitudinally therealong for gripping the pin 100 effectively. The retaining finger 70 is pivotable between a retaining position where the bowling pin 100 is frictionally retained and a release position where a retained bowling pin 100 is released, such as for dispensing to its set position on the pin deck 16.

As taught herein, the reconfigurable pin setting array 12 can itself be movable between a pin setting position as in FIG. 7 where the pin setting array 12 is disposed immediately above the pin deck 16 and a retracted position as in FIG. 8 where the pin setting array 12 is at least partially removed from the pin deck 16. In this embodiment, the retracted position of the pin setting array 12 is entirely removed from the volume above the pin deck 16 by movement to a posterior position wherein the pin setting array 12 is disposed behind a divider 36. In presently contemplated embodiments, the divider 36 is a folding curtain retained by a framework and can be actuated between folded and unfolded configurations by an actuator 37, but it could be a wall or some other divider 36. Sidewalls 38 can be further included where necessary or desirable.

Movement between the pin setting position above the pin deck 16 and the retracted position at least partially removed from the pin deck 16 could be achieved by plural different types of movements or combinations thereof, each included within the scope of the invention except as the claims might be expressly limited. In the embodiment of the pin setting mechanism 10 of FIGS. 1 through 5 and 7-10, the pin setting array 12 is movable longitudinally in relation to the pin deck 16 and the alley 18 between a pin setting position above the pin deck 16 for setting bowling pins 100 in a predetermined array and a retracted or storage position moved posteriorly and, in this embodiment, entirely removed from the area above the pin deck 16. When in a storage position, the pin setting array 12 can be disposed behind the divider 36.

The pin setting array 12 is retained by a support platform 28 and can be raised and lowered relative thereto, such as by a pressurized cylinder 40. Left and right slide bars 26 further couple the pin setting array 12 relative to the platform 28 and ensure smooth raising and lowering of the pin setting array 12 relative to the platform 28 and maintain the pin setting array 12 in a precise and consistent alignment for proper setting of bowling pins 100.

The platform 28 and, through the platform 28, the pin setting array 12 are retained for slidable, longitudinal movement of the platform 28 and the pin setting array 12 by a gantry 15. The gantry 15 permits the longitudinal position of the platform 28 and the pin setting array 12 to be adjusted between the anterior position of FIGS. 1 and 7 wherein the pin retention mechanisms 24 are in the space over the pin deck 16 and the posterior position of FIGS. 8 through 10 where the pin retention mechanisms 24 are entirely removed from the space above the pin deck 16. Here, the gantry 15 has first and second opposed rails or tracks 25 disposed adjacent to the upper edges of the sidewalls 38 and followers 27 fixed to the outboard ends of the platform 28 that travel along the tracks 25. The rails or tracks 25 and the followers 27 can be of any effective type that permit longitudinal movement of the platform 28. By way of example and not limitation, the rails or tracks 25 can have upper and lower faces against which one or more wheels of the followers 27 roll to permit smooth, controlled movement of the platform 28 and the pin setting array 12. Movement of the platform 28 can be performed by an actuator 29, which could be a pneumatic or hydraulic actuator, a motorized gear actuator, or any other effective actuator.

Under this configuration, therefore, the pin setting array 12 can be moved longitudinally between a pin setting position anterior to the divider 36 and over the pin deck 16 and a retracted or storage position behind the divider 36 such that the area above the pin deck 16 is left open of the pin setting array 12. By operation of the cylinder 40 and the left and right slide bars 26, the pin setting array 12 can lowered to be brought to an appropriate height for pin setting, such as with the bottoms of the bowling pins 100 in contact with the pin deck 16, and then raised to permit evacuation of the pin setting array 12 to a position above the pin deck 16.

Figure 10:
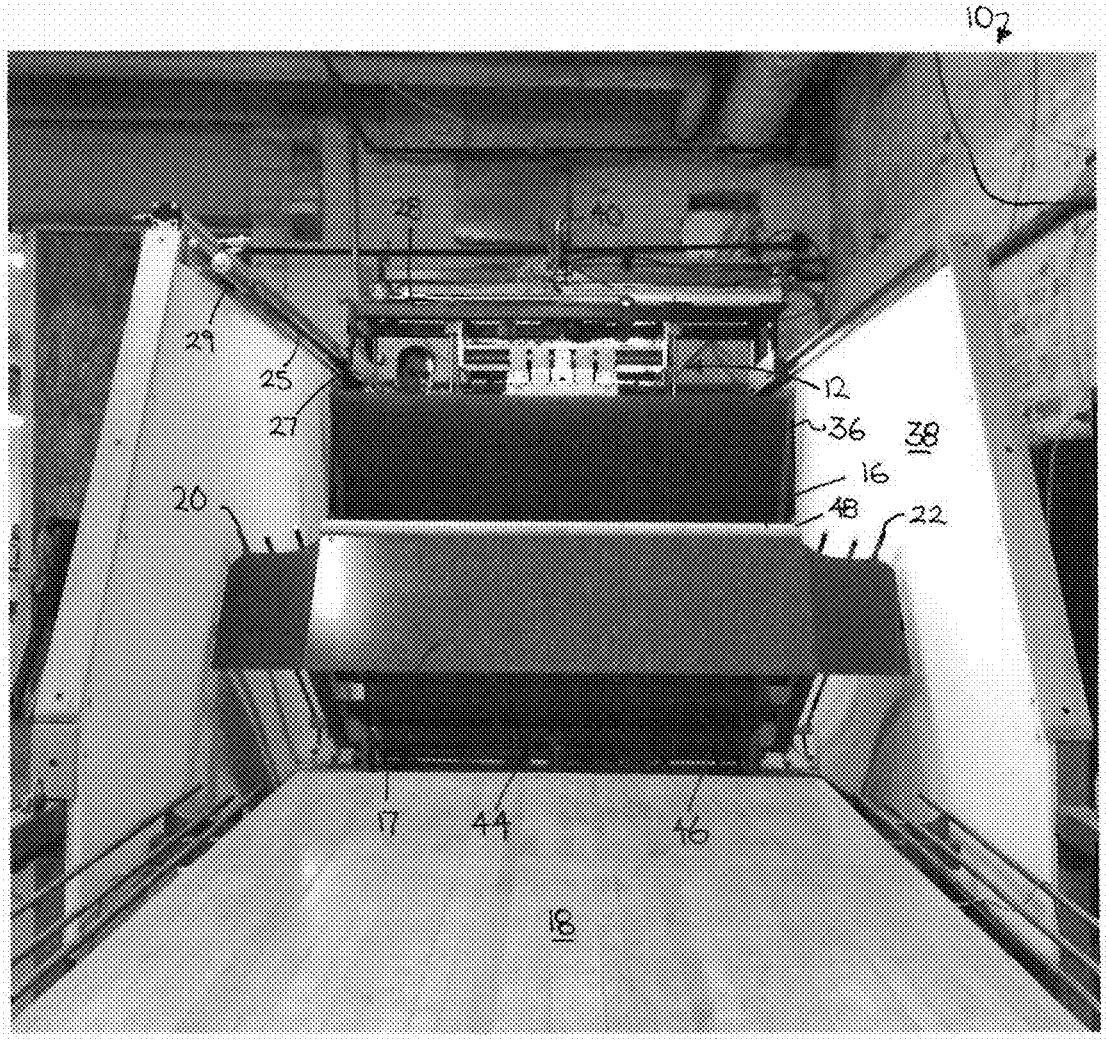
FIG. 10 is a view in front elevation of the bowling pin setting system of FIG. 5 with the reconfigurable bowling pin setting array in an contracted configuration and in a posterior, raised position and with the pin deck pivoted to a raised position.

Looking more particularly to FIG. 10, the bowling pin setting system 10 additionally includes a pin deck 16 that is pivotable from a flat position as is illustrated, for example, in FIGS. 1 through 5 and 7 through 9 to the raised position illustrated in FIG. 10. In this embodiment, the pin deck 16 is pivotable about a lateral pivot axis disposed at or adjacent to the posterior end of the pin deck 16 by operation of one or more pressurized cylinders 44. The pin deck 16 can be pivotable to any necessary angle and in one embodiment is pivotable to approximately 45 degrees. When pivoted, such as in response to a bowler's pressing a reset button or other control mechanism or sensed event, the pin deck 16 is operable to clear any remaining pins from the pin deck 16 and into the pin pit for reloading into the pin setting array 12 as described further hereinbelow. With the pins 100 cleared from the pin deck 16, the deck 16 can lower again to be coplanar with the surface of the bowling alley 18.

As seen in FIG. 10, the pin deck 16 can include one or more face panels 17 coupled to the anterior end of the deck 16 thereby to close the gap that would otherwise be created partially or completely. The face panel or panels 17 could be pivotally coupled to the distal or anterior end of the pin deck 16 to hang therefrom as the pin deck 16 is raised. If necessary, the face panel 17 could be articulated to accommodate the raising and lowering of the pin deck 16. In other embodiments, the face panel 17 could be arcuate thereby to facilitate close contact with the end of the bowling alley 18 to prevent, among other things, an ill-timed bowling ball from falling below the pin deck 16.

With the pin deck 16 lowered or lowering into position, the pin setting array 12 can simultaneously, subsequently, or otherwise be brought from the storage position to the dispensing position by one or more of longitudinal movement forward by operation of the gantry 15 and vertical movement upward from a lowered position behind the divider 36 and then downward movement into position for pin setting by operation of the pressurized cylinder 40. The pin setting array 12 can be reconfigured from the contracted configuration to the expanded configuration, and bowling pins 100 retained by the pin retention mechanisms 24 can then be set on the pin deck 16 in a precise equilateral triangle. With the bowling pins 100 set, the pin setting array 12 can be raised from the dispensing position, slid posteriorly to the storage configuration, lowered, and adjusted to the contracted configuration to be reloaded with bowling pins 100 for the next dispensing.

As referenced above, the bowling pin setting system 10 includes gutters 20 and 22 that communicate longitudinally beside the pin deck 16 and the bowling alley 18. Of course, gutters 20 and 22 are standard in the art. Here, however, each gutter 20 and 22 is formed by a plurality of longitudinal bars or rails, three in this example, that are disposed along an arcuate curve designed to cradle and guide bowling balls received from the bowling alley 18 or the pin deck 16. The spaces between the rails are generally open. The gutters 20 and 22 can be divided into portions with bowling alley portions that communicate longitudinally along the bowling alley 18 and portions that communicate longitudinally along the pin deck 16. The portions of the gutters 20 and 22 that communicate longitudinally along the pin deck 16 can be fixed to pivot with the pin deck 16 as shown, for example, in FIG. 10.

A plurality of advantages and opportunities arise through the use of rails with open spaces therebetween to form the gutters 20 and 22. By way of example, lighting sources can be disposed under one or more of the pin deck 16, the bowling alley 18, or the gutters 20 and 22 themselves. With that, supplemental and advanced lighting effects can be provided in a manner not possible with the gutters of the current state of the art. The open spaces within the gutters 20 and 22 also permit ventilation of the pin deck 16 and the pin deck 18 and enhanced access thereby to, among other things, reduce fire risks and improve firefighting access.

Employing longitudinal rails to form the gutters 20 and 22 also permits the gutters 20 and 22 to be selectively closed off to prevent rolled balls from being received into one of the gutters 20 and 22, such as might be desirable for novice and young bowlers. More particularly, one or more of the rails forming the gutters 20 and 22 can be selectively raised to project higher than the playing surface of the bowling alley 10. With that, the gutters 20 and 22 themselves can selectively prevent balls from falling into the gutters. It would be possible for the entire gutters structures 20 and 22 to be raised and lowered. Alternatively, as in the depicted embodiment, the innermost rail is capable of being raised and lowered thereby to present a guardrail against rolled balls falling into the gutters 20 and 22.

As FIGS. 1 through 5 and 10 show, the bowling lane 18, the pin deck 16, and the gutters 20 and 22 can be supported by an elevated metal substructure 46. The metal substructure 46 includes lateral primary braces joined with longitudinal members and supported by legs, such as by welding, mechanical fasteners, or any other fastening arrangement or combination thereof. The longitudinal members can traverse from the posterior end to the anterior end of the pin deck 16. The lateral primary braces in this embodiment span to support the gutters 20 and 22 at the distal ends of the lateral primary braces and the decking 48 or other surface material of the pin deck 16. The alley 18 can be similarly constructed.

With such a metal substructure 46, assembly and installation of the bowling system 10 can be accomplished with efficiency and speed. Moreover, the bowling system 10 can be assembled with relative ease, even over a contoured floor surface. The space under the pin deck 16 and the bowling alley 18 can be left open or substantially open thereby reducing fire risks, requiring less space, and permitting the retention of other accessories, including lighting sources. Flammable materials are removed from under the bowling alley 18 and the pin deck 16, and the open space permitted by the metal substructure 46 can permit, among other things, automated cleaning and a cleaner subsurface area in general.

The bowling system 10 includes a pin assembly and loading system, which can be understood with further reference to FIGS. 3 through 6 and 15 through 17. The pin assembly and loading system receives bowling pins 100, such as pins 100 cleared or falling from the pin deck 16, assembles them into an organized format, and loads them into the pin setting array 12. With the pin setting array 12 loaded, the bowling pins 100 can be dispensed as described previously such as by releasing the fingers 70 of the pin retention mechanisms 24.

The process of assembling and loading bowling pins 100 begins with receiving the pins 100 into a rotational hopper or turntable 74. There, the pins 100 are rotated within the rotating turntable 74 and dispensed to a conveyor 76, such as by the combined force of gravity and the centrifugal force of the rotating turntable 74. The conveyor 76 comprises an endless pin reception framework retained and conveyed, for example, by gearing. In this example of the invention, the pins 100 are disposed in horizontal orientations generally aligned with a longitudinal of the bowling pin deck 16 and, ultimately, the bowling alley 18. While the bowling pins 100 are in a horizontal position, the conveyor 76 receives pins into the pin reception framework, carries the pins 100 vertically upward, and feeds them to a cartridge or assembly magazine 78, which could alternatively be referred to as a pin flipper or a pivoting magazine 78, to cause a plurality of pins 100 to be disposed in juxtaposition within the pivoting magazine 78 as shown perhaps most clearly in FIG. 17. As the pivoting magazine 78 receives the pins 100, it too is disposed in what may be considered a horizontal orientation. It would be possible to have one pivoting magazine 78 or plural pivoting magazines 78, such as an anterior pivoting magazine 78 and a posterior pivoting magazine 78. In any case, a pivoting magazine 78 could receive and retain five bowling pins 100 with each loading of the flipper 78 corresponding to the number of pin retention mechanisms 24 in a given row of pin retention mechanisms 24 of the pin setting array 12. Once a sensor detects that the pivoting magazine 78 is loaded with a predetermined number of pins 100, the conveyor 76 can be automatically stopped.

Figure 16:
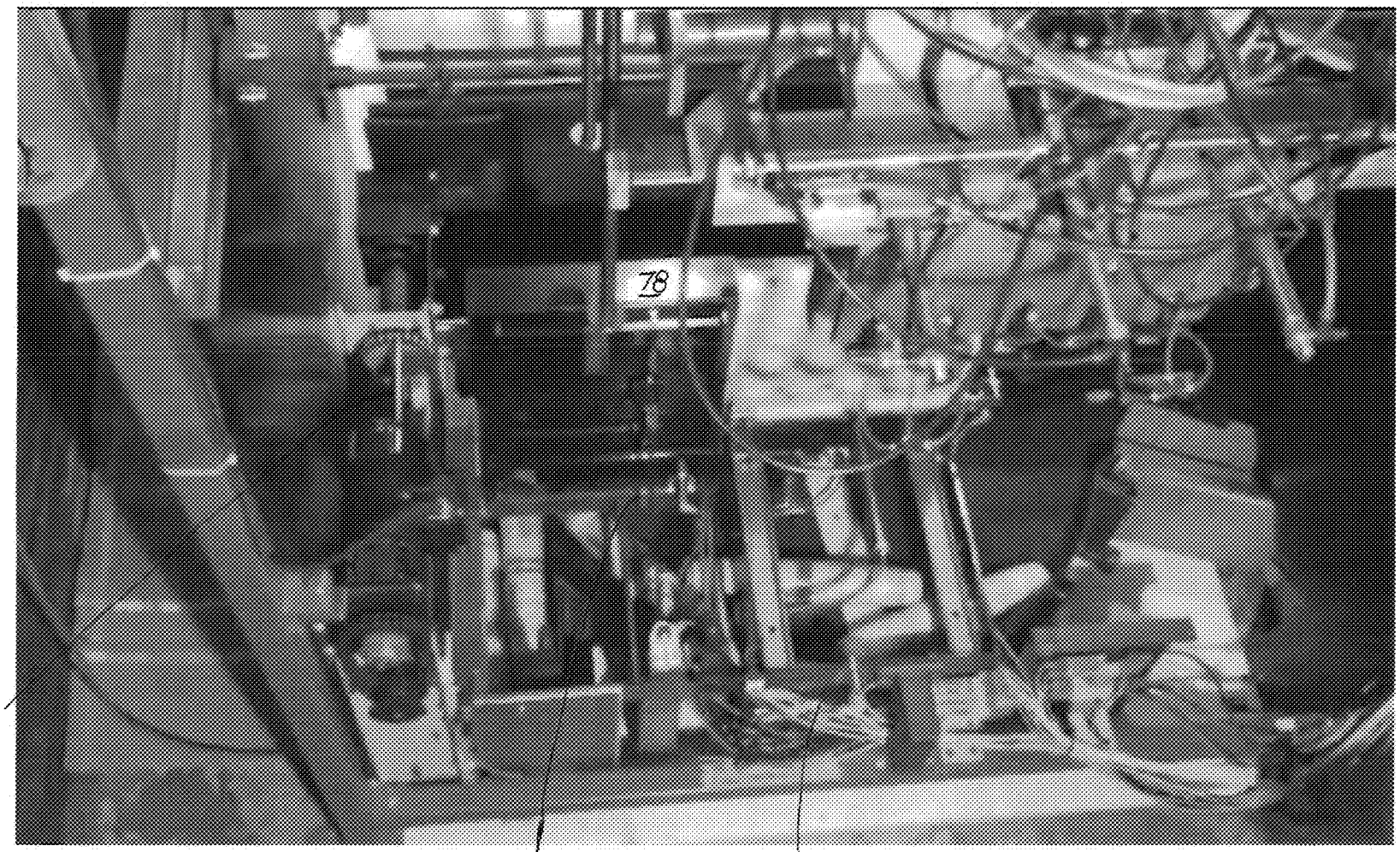
FIG. 16 is a perspective view of a pin assembly and loading system pursuant to the invention during loading of a first pin magazine.
Figure 17:
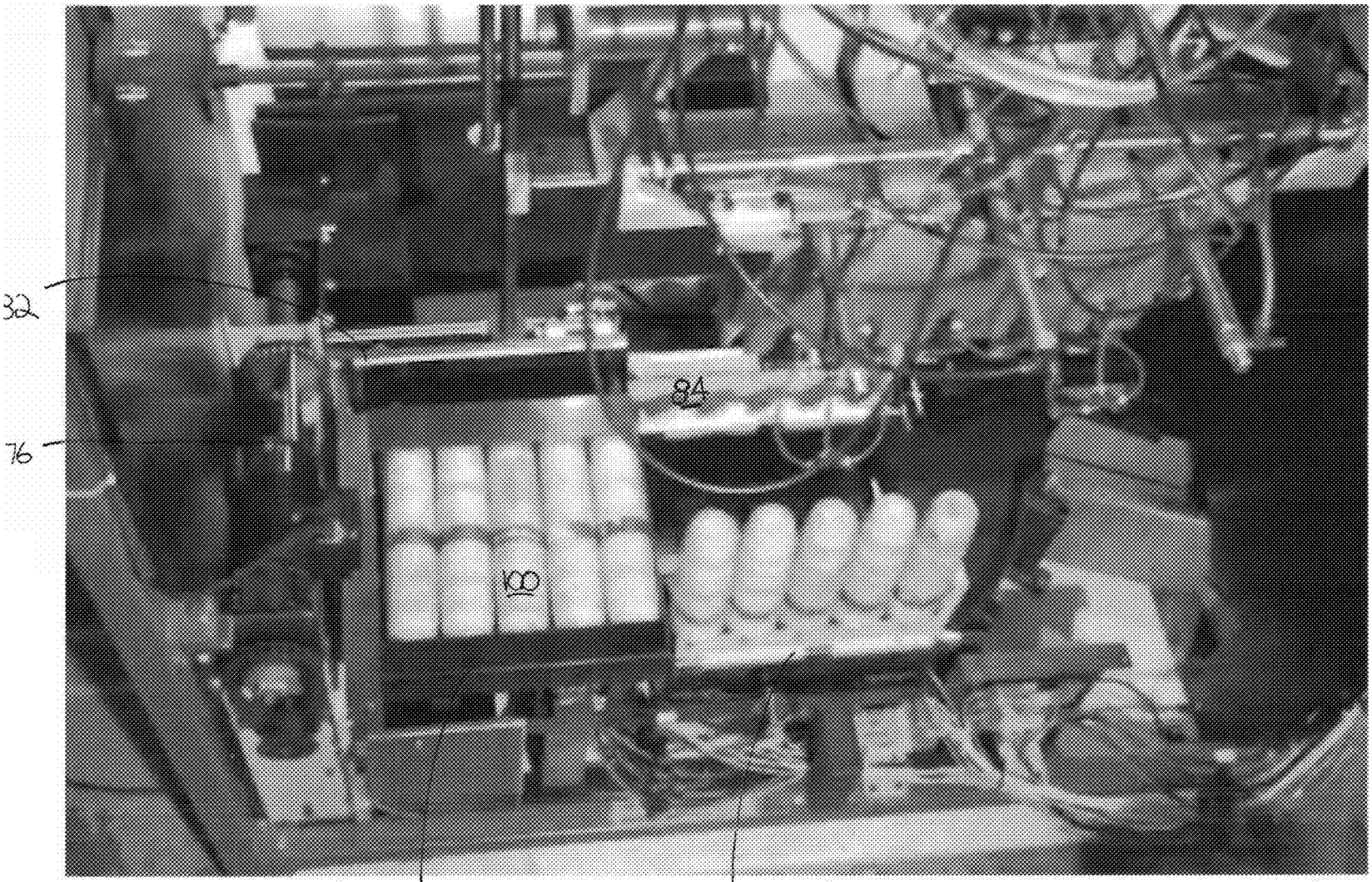
FIG. 17 is a perspective view of a pin assembly and loading system pursuant to the invention with the first pin magazine loaded and the pivoting magazine loaded with pins to be loaded into the second pin magazine.

When the pivoting magazine 78 is fully loaded with bowling pins 100, the pivoting magazine 78 and the bowling pins 100 retained thereby can be pivoted or flipped, such as by a lifting mechanism 80, from their horizontal orientation as shown, for example in FIG. 17, to a vertical orientation as shown, for example, in FIG. 16. The lifting mechanism 80 could be of any effective type, including a pressurized fluidic cylinder, gearing, or some other mechanism. When vertically oriented, the pivoting magazine 78 and the bowling pins 100 retained thereby are in or can be brought into lateral alignment with a pin loading magazine 84 by one or more actuators 86. In this embodiment, there is a first, anterior pin loading magazine 84 and a second, posterior pin loading magazine 84. Where necessary, the pin loading magazine or magazines 84 can be selectively brought into alignment to align with the anterior and posterior rows of pin retention mechanisms 24 of the pin setting array 12, such as by the actuators 86.

While anterior and posterior pin magazines 84 can be employed, it would also be possible to have a single pin magazine 84 loaded more than once. It would additionally or alternatively be possible for the pivoting magazine 78 to be selectively moved to align with the pin loading magazines 84, such as but not limited to by being bi-directionally pivotable or by being capable of translation or other movement. For instance, a flipper 78 could be pivoted forward to align with the anterior pin loading magazine 84 or rearward to be upside-down compared to its forward pivoted position to align with the posterior pin loading magazine 84. This could be advantageous where the bowling system 10 is designed for use with candlepin bowling pins 100, which are longitudinally symmetrical. Still further, it would be possible to load the pin magazines 84 while in a horizontal or other position and then to stand the magazines 84 to a vertical position, such as by an actuator (not shown).

In any event, in the depicted embodiment, with the pivoting magazine 78 disposed in an upright position, one of the pin loading magazines 84 can be aligned end-to-end or laterally with the flipper 78. This could be carried out by movement of the pivoting magazine 78, by movement of one or both magazines 84, or both. In the depicted embodiment, the magazines 84 can be moved laterally to align with the pivoting magazine 78 by one or more actuators 86, which in this embodiment comprise pneumatic cylinders but which could be any effective actuation mechanism.

Figure 15:
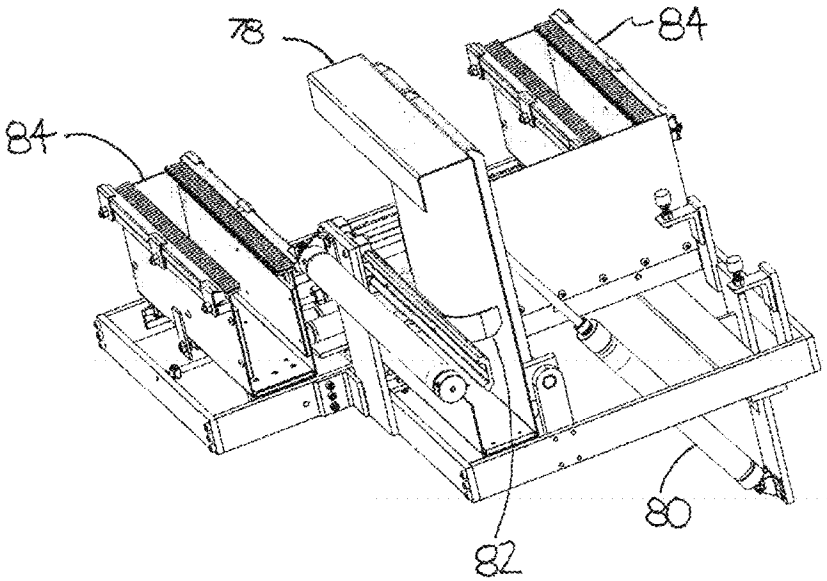
FIG. 15 is a perspective view of a pin loading system according to the invention.

With the pivoting magazine 78 aligned with a pin loading magazine 84, the pins 100 can be fed from the pivoting magazine 78 and into the respective pin loading magazine 84. In this embodiment, the pins 100 are slid laterally in series from the pivoting magazine 78 and into the pin loading magazine 84, such as by a push drive mechanism 82. As best seen in FIGS. 5 and 15, the push drive mechanism 82 in this manifestation has a flat lateral portion that can face the several bowling pins 100 during application of the drive mechanism 82 and an orthogonal end portion or finger that can engage and push the bowling pin 100 distal to the pin loading magazine 84 and, through that pin 100, all of the pins 100 toward and into the pin loading magazine 84.

With the anterior and posterior pin loading magazines 84 loaded with bowling pins 100, the magazines 84 can be repositioned if and as necessary by the actuators 84 to correspond to the anterior and posterior rows of pin retention mechanisms 24. With the pin setting array 12 in a contracted configuration, the pin setting array 12 can be lowered into place thereby causing the ten bowling pins 100 to be received into the ten pin retention mechanisms 24. The pin retention mechanisms 24 can then engage the bowling pins 100, such as by actuation of the gripping fingers 70, to cause the pins 100 to be retained by the pin setting array 12.

When appropriate, such as when a bowler presses a reset button or automatically on completion of a frame, the pin setting array 12, now retaining ten bowling pins 100, can be raised, such as by the pressurized cylinder 40 or any other actuator, and moved by operation of the gantry 15 to its anterior position over the pin deck 16. The pin setting array 12 can then be lowered into position and the pin retention mechanisms 24 adjusted to the expanded configuration. The bowling pins 100, now disposed in a proper equilateral triangle, can then be released by actuation of the pin gripping fingers 70 and set on the pin deck 16 to permit the commencement of a new frame.

The bowling system 10 so described can be carried forth in an exceedingly mechanically and energy efficient manner. While prior art pin setting machines can require six or more motors per machine, embodiments of the bowling system 10 are contemplated where an entire system 10 or even multiple systems 10 can be operated by a single motor. For example, where the several mechanisms of the system 10 are operable by pressurized fluid, whether hydraulic or pneumatic, a single motor can supply the necessary fluid pressure to the several subsystems. With that, highly advantageous efficiencies can be realized.

The mechanical movements and processes disclosed herein can be controlled by electronics and associated programming that will be within the skill of one knowledgeable in the art who has had the opportunity to review the present disclosure. It is contemplated that a single electronic chipset could control more than one bowling system 10 simultaneously. Electronic controls pursuant to the invention could automatically or selectively report to one or more central management systems and authorities, such as a bowling center management system. The reporting could include basic game data, such as strikes, spares, and overall score. The system 10 could also sense and report enhanced data. By way of example and not limitation, the system 10 could include radar sensors such that the system 10 could detect, display, and analyze ball speed, ball movement, and other data.

The bowling pin setting system 10 described above is just one of the many possible manifestations of the invention. By way of example and not limitation, other mechanisms for conveying a pin setting array 12 between an anterior position and a posterior position are possible and are within the scope of the invention except as may be expressly excluded by the claims. Moreover, other systems for adjusting a pin setting array 12 from a contracted configuration to an expanded configuration may occur to one skilled in the art after becoming aware of the present disclosure.

One alternative construction of the bowling pin setting system 10 can be better understood with reference to FIGS. 18 through 25. There, the bowling pin setting system 10 is again founded on a reconfigurable pin setting array 12 of ten pin retention mechanisms 24. The pin retention mechanisms 24 receive, retain, and release bowling pins during a cycle or frame of bowling play. The pin setting array 12 in this manifestation of the pin setting system 10 is again configured for retaining candlepin bowling pins, but it will be understood that other types of bowling pins, including ten pin bowling pins and duck pins, could be retained and set within the scope of the invention except as it might be expressly limited by the claims.

Figure 20:
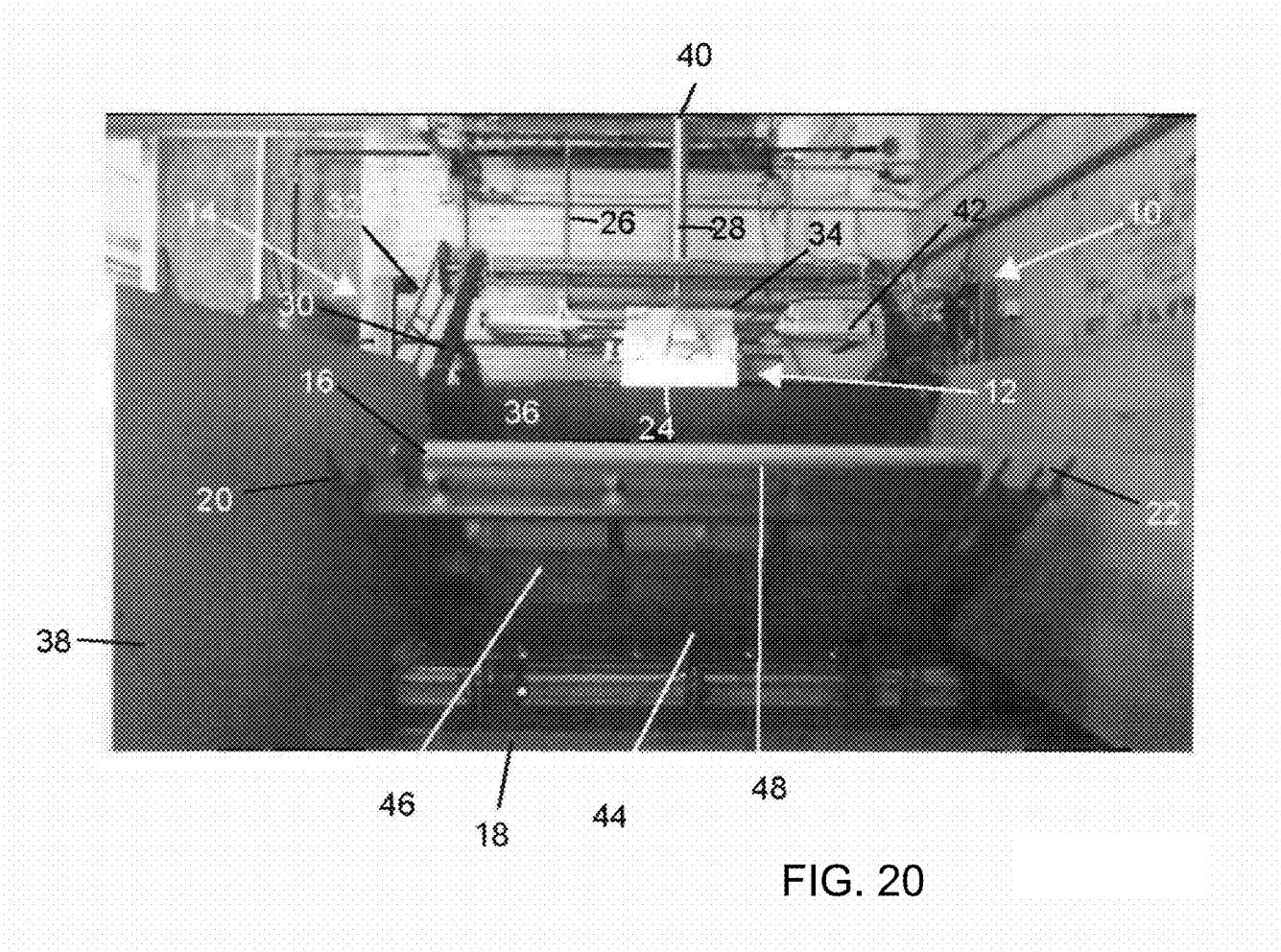
FIG. 20 is a view in front elevation of a bowling pin setting system of FIG. 18 with the reconfigurable bowling pin setting array in an contracted configuration and in an posterior position and with the pin deck pivoted to a raised position.

As seen, for instance, in FIG. 20, the pin setting array 12 has a contracted configuration where the pin retention mechanisms 24 and any bowling pins (not shown in FIG. 20) retained thereby are disposed in immediate proximity to one another. The contracted configuration again has two rows of five pin retention mechanisms 24, but other configurations are possible. With the bowling pin setting system 10 assumed to have a longitudinal direction aligned with the longitudinal direction of the bowling alley 18 and a lateral direction perpendicular thereto, the rows of pin retention mechanisms 24 are aligned in a lateral direction so that there is an anterior row of five pin retention mechanisms 24 and a posterior row of five pin retention mechanisms 24.

Each pin retention mechanism 24 is dedicated to a given pin position in the final bowling pin setup so that the ten pin retention mechanisms 24 can again be referred to by their final pin position in the expanded configuration. The anterior row has the 4, 2, 1, 3, and 6 pin retention mechanisms 24 and pins disposed in that order from left to right, and the posterior row has the 7, 8, 5, 9, and 10 pin retention mechanisms 24 and pins disposed in that order from left to right.

Figure 18:
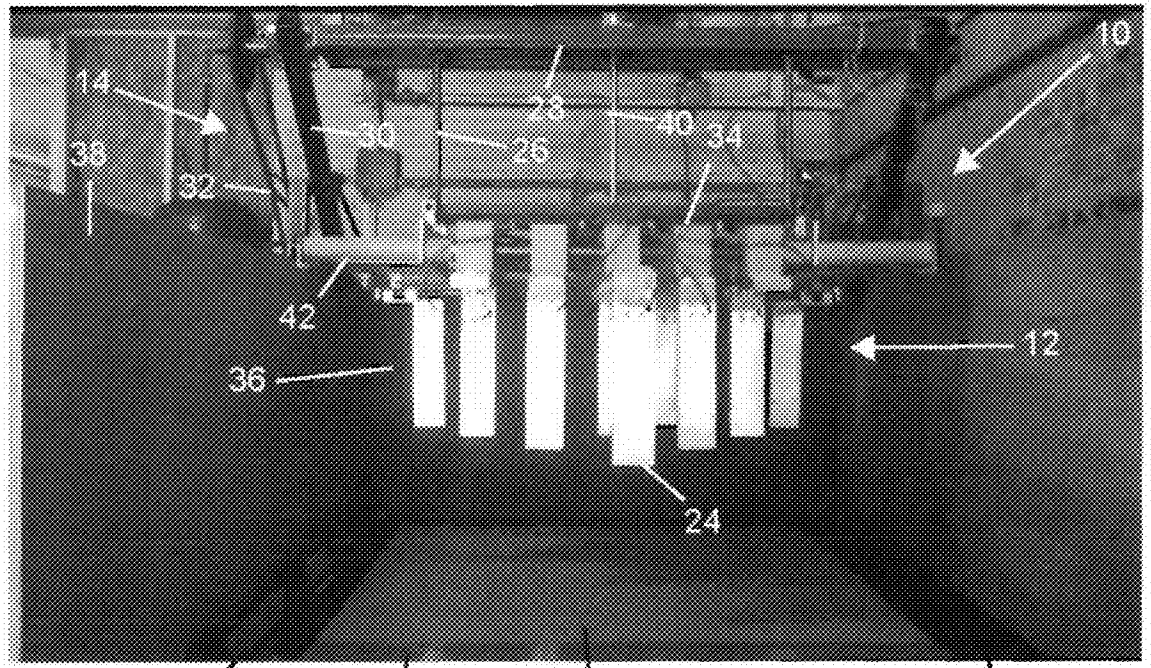
FIG. 18 is a view in front elevation of an alternative bowling pin setting system pursuant to the invention with the reconfigurable bowling pin setting array in an expanded configuration and in an anterior, lowered position.

The pin setting array 12 is reconfigurable to an expanded configuration as shown in FIG. 18. When adjusted to the expanded configuration, the pin retention mechanisms 24 correspond in location to the final dispensing configuration of the bowling pins. In this example, with ten pin retention mechanisms 24 configured for candlepin bowling with ten pins, the pin retention mechanisms 24 move from the double row, contracted configuration to an expanded, equilateral triangle configuration.

The movement patterns of the pin retention mechanisms 24 could vary widely within the scope of the invention. Here, the pin retention mechanisms 24 of the anterior row are automatically reconfigured to their final positions with the 1 pin retention mechanism 24 moving anteriorly, the 2 and 3 pin retention mechanisms 24 move laterally outward, and the 4 and 6 pin retention mechanisms 24 moving posteriorly and outwardly, in either order or simultaneously. The pin retention mechanisms 24 of the posterior row are automatically reconfigured to their final pin positions with the 5 pin retention mechanism 24 moving anteriorly and the 7, 8, 9, and 10 pin retention mechanisms 24 moving laterally outward. It will again be noted that movement of the pin retention mechanisms 24 between the contracted and expanded configurations could be achieved in numerous ways within the scope of the invention, including but not limited to by hydraulics, pneumatics, gearing, or any combination thereof, or by any other system capable of producing the desired movement.

Figure 21:
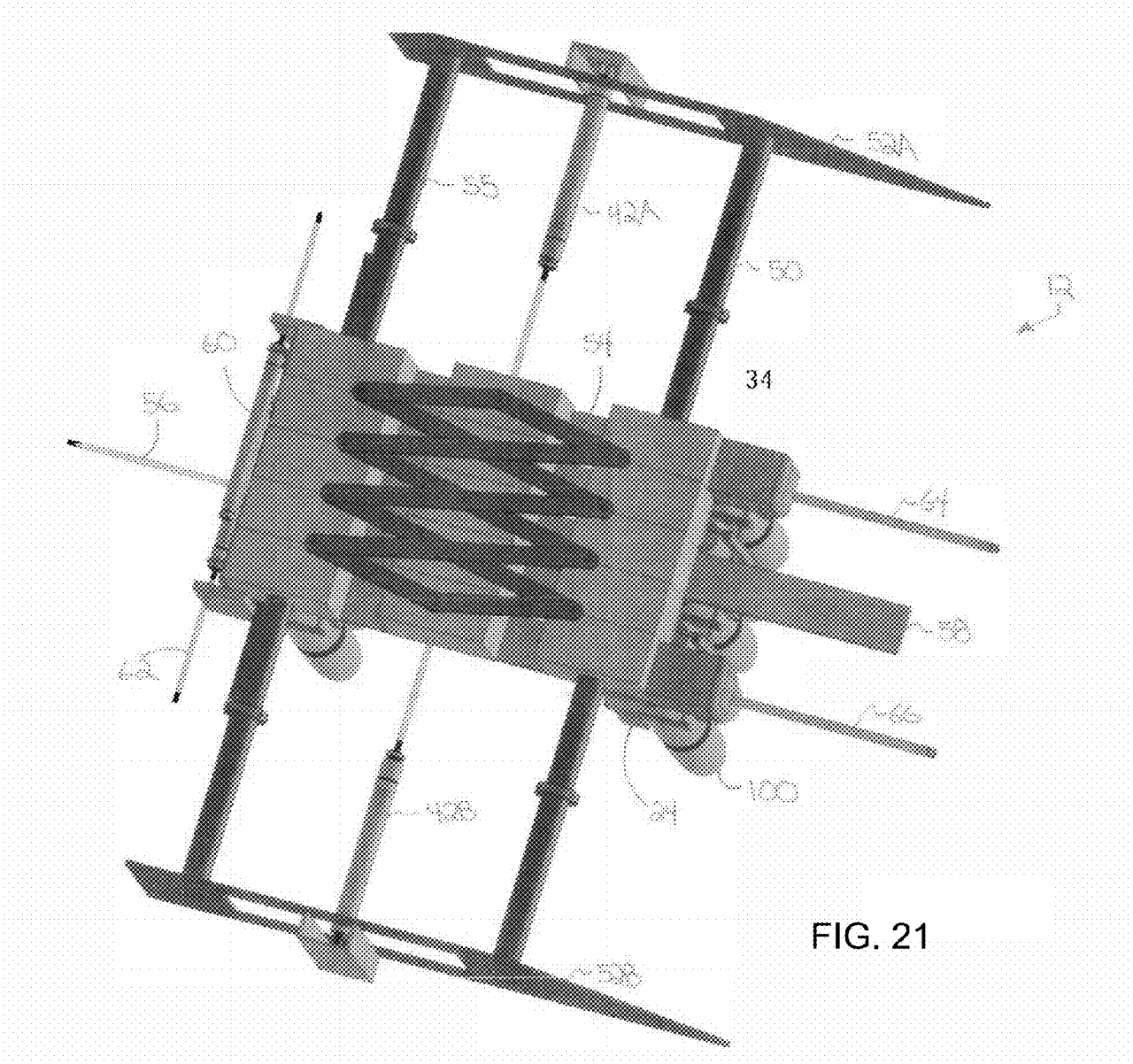
FIG. 21 is a perspective view of a bowling pin setting mechanism embodying the invention in a contracted configuration.
Figure 22:
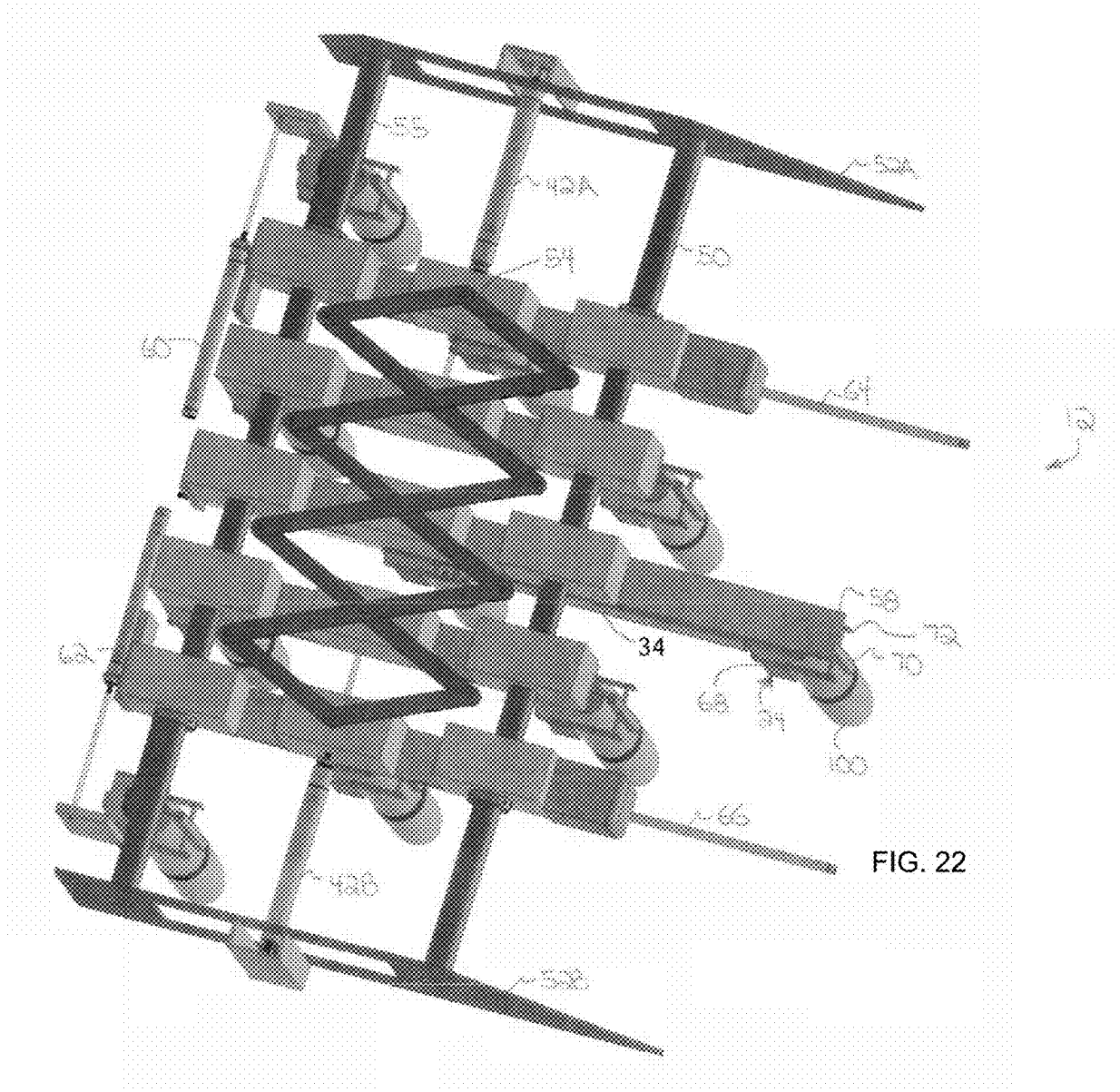
FIG. 22 is a perspective view of the bowling pin setting mechanism of FIG. 21 in an expanded configuration.

As illustrated in FIGS. 21 and 22, movement of the pin retention mechanisms 24 in this manifestation is performed by pressurized fluid systems, which could be hydraulic or pneumatic. The pressurized fluid systems include main lateral right and left pressurized cylinders 42A and 42B that operate to extend and retract an extension and retraction mechanism, which here is a scissor mechanism 54 but which again could be a hydraulic or pneumatic mechanism, or any other effective mechanism, laterally to produce the desired lateral movement of the pin retention mechanisms 24. Outer lateral pressurized cylinders 60 and 62 are operative to move the 7 and 10 pin retention mechanisms 24 laterally, and longitudinal pressurized cylinders 56, 64, and 66 produce necessary longitudinal movement of pin retention mechanisms 24. As necessary, such as with the 1 and 5 pin retention mechanisms 24, the pin retention mechanisms 24 can be longitudinally movable along longitudinal guide members 58, and the longitudinal guide members 58 or the pin retention mechanisms 24 directly can be laterally movable along anterior and posterior lateral slide bars 50 and 55, which can in turn be supported by side brackets 52A and 52B. As illustrated, the pin retention members 24 can be slidable along the lateral slide bars 50 and 55 through, for example, slide blocks 34 that slidably engage the bars 50 and 55.

With this, by combined operation of the pressurized cylinders 42A, 42B, 56, 60, 62, 64, and 66, the pin retention mechanisms 24 can be rapidly moved between the contracted configuration of, for example, FIG. 21 and the expanded configuration of, for example, FIG. 22. For example, to reconfigure the pins from the contracted to expanded configurations, the 1 and 5 pin retention mechanisms 24 can be moved anteriorly. The 2 and 3 pin retention mechanisms 24 can be moved laterally outward, the 4 and 6 mechanisms 24 can be moved laterally outward and posteriorly, and the 7, 8, 9, and 10 pin retention mechanisms 24 can be moved laterally outward. The process can be reversed to return to the contracted configuration.

As before, each pin retention mechanism 24 is capable of selectively retaining and releasing a bowling pin 100 as is illustrated, for example, in FIGS. 21 and 22. This too could be done in numerous different ways, including any of the many methods already disclosed or any method that might in the future be developed. In the depicted example, where the pin retention mechanisms 24 retain candlepin bowling pins 100, each pin retention mechanism 24 selectively grips and retains a bowling pin 100 by the combined effects of a retaining wall 68 and a retaining finger 70 operative by a pivoting mechanism 72 that could also be actuated by pressurized fluid. The retaining finger is pivotable between a retaining position where the bowling pin 100 is frictionally retained and a release position where a retained bowling pin 100 is released, such as for dispensing to its set position on the pin deck 16.

Figure 19:
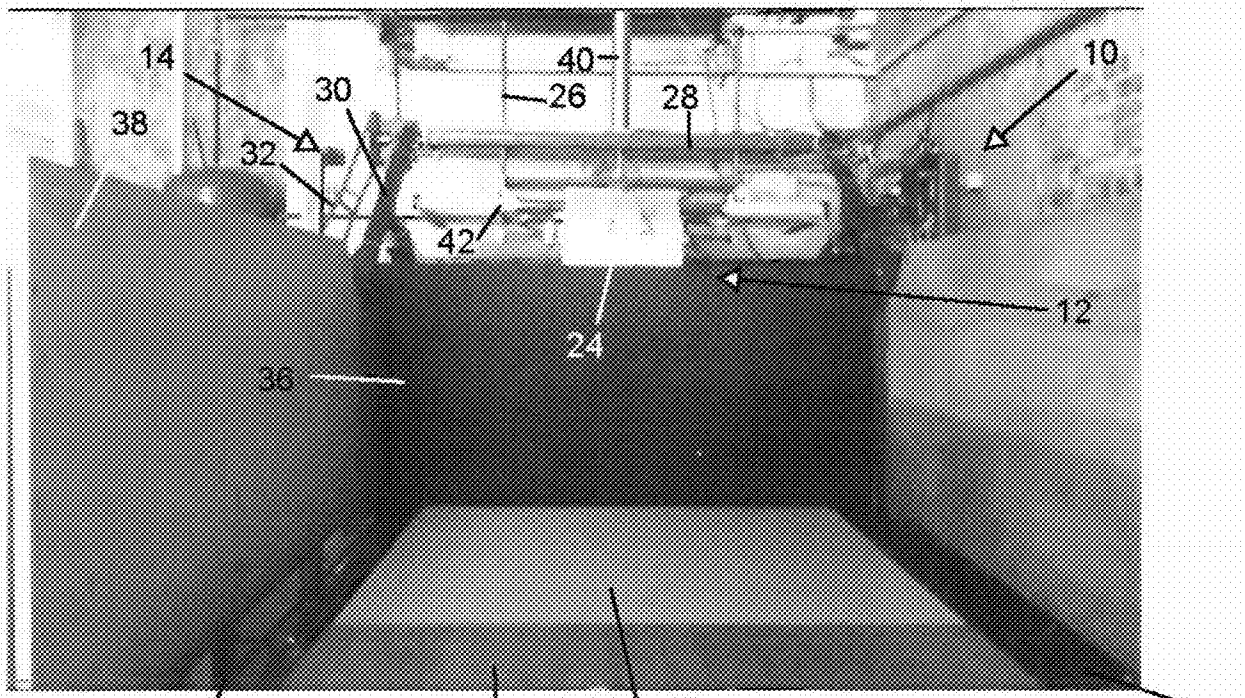
FIG. 19 is a view in front elevation of the bowling pin setting system of FIG. 18 with the reconfigurable bowling pin setting array in a contracted configuration and in a posterior position.

The reconfigurable pin setting array 12 is movable between a forward or pin setting position where the pin setting array 12 is disposed immediately above the pin deck 16 as in FIG. 18 and a rearward or retracted position as in FIG. 19 where the pin setting array is at least partially removed from the pin deck 16. In this embodiment, when in the rearward position, the pin setting array 12 is moved posteriorly to be removed from the volume above the pin deck 16 and behind the divider 36. Again, the divider 36 could be a curtain, a wall, or some other divider 36. Sidewalls 38 can be further included where necessary or desirable.

In the embodiment of the pin setting mechanism 10 of FIGS. 18 through 20, the pin setting array 12 is pivotable between the forward, pin setting position above the pin deck 16 for setting bowling pins 100 in a predetermined array and the rearward, retracted or storage position entirely removed from the area above the pin deck 16. The platform 28 and, through the platform 28, the pin setting array 12 are pivotally retained by a pivoting mechanism 14. The pivoting mechanism 14 in this embodiment comprises a pair of pivoting arms 30 in cooperation with a chain and sprocket combination 32, which operates to pivot the arms 30. Of course, the arms 30 could readily be otherwise manipulated.

The pin setting array 12 is again retained by a support platform 28 and can be raised and lowered relative thereto, such as by a pressurized cylinder 40. Left and right slide bars 26 further couple the pin setting array 12 relative to the platform 28 and ensure smooth raising and lowering of the pin setting array 12 relative to the platform 28 and maintain the pin setting array 12 in a precise and consistent alignment for proper setting of bowling pins 100.

So constructed, the pin setting array 12 can be pivoted between a pin setting position anterior to the divider 36 and over the pin deck 16 and a retracted or storage position behind the divider 36 whereby the area above the pin deck 16 is left open of the pin setting array 12. The pin setting array 12 can be raised and lowered to be brought to an appropriate height for pin setting, such as with the bottoms of the bowling pins 100 in contact with the pin deck 16.

The bowling pin setting system 10 again includes a pin deck 16 that is pivotable from a flat position as is illustrated, for example, in FIG. 18 to the raised position illustrated in FIG. 20. The pin deck 16 is pivotable about a lateral pivot axis disposed at or adjacent to the posterior end of the pin deck 16 and can be actuated by, for instance, a pressurized cylinder or cylinders 44 or any other mechanism. The pin deck 16 can be pivotable to any necessary angle, such as but not limited to approximately 45 degrees. When the pin deck 16 is pivoted, it is operable to clear any remaining pins 100 from the pin deck 16 and into the pin hopper or pit 74 for reloading into the pin setting array 12 as described further hereinbelow. With the pins cleared from the pin deck 16, the deck 16 can lower to again be coplanar with the surface of the bowling alley 18.

With the pin deck 16 lowered or lowering into position, the pin setting array 12 can simultaneously, subsequently, or otherwise be brought from the rearward, storage position to the forward, dispensing position by a pivoting of the arms 30. The pin setting array 12 can be lowered into position, such as by operation of the pressurized cylinder 40. The pin setting array 12 can be reconfigured from the contracted configuration to the expanded configuration, and bowling pins 100 retained by the pin retention mechanisms 24 can then be set on the pin deck 16 in a precise equilateral triangle. With the bowling pins set, the pin setting array 12 can be raised from the forward, dispensing position, pivoted toward the rearward, storage configuration, and adjusted to the contracted configuration to be reloaded with bowling pins 100 for the next cycle.

Figure 23:
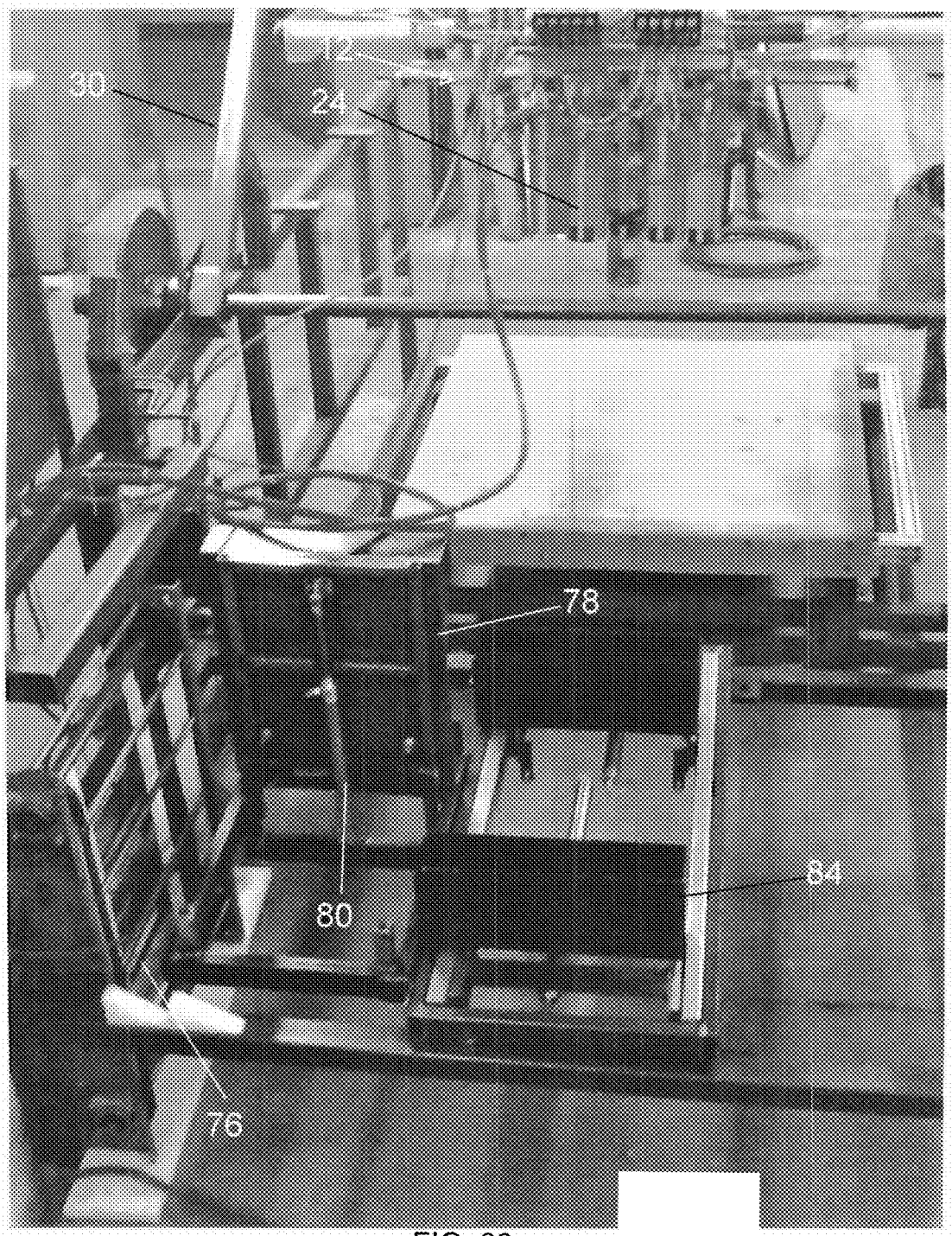
FIG. 23 is a perspective view of a pin assembly and loading system as taught herein wherein the pin assembly and loading system is partially dismantled for clarity of illustration.
Figure 24:
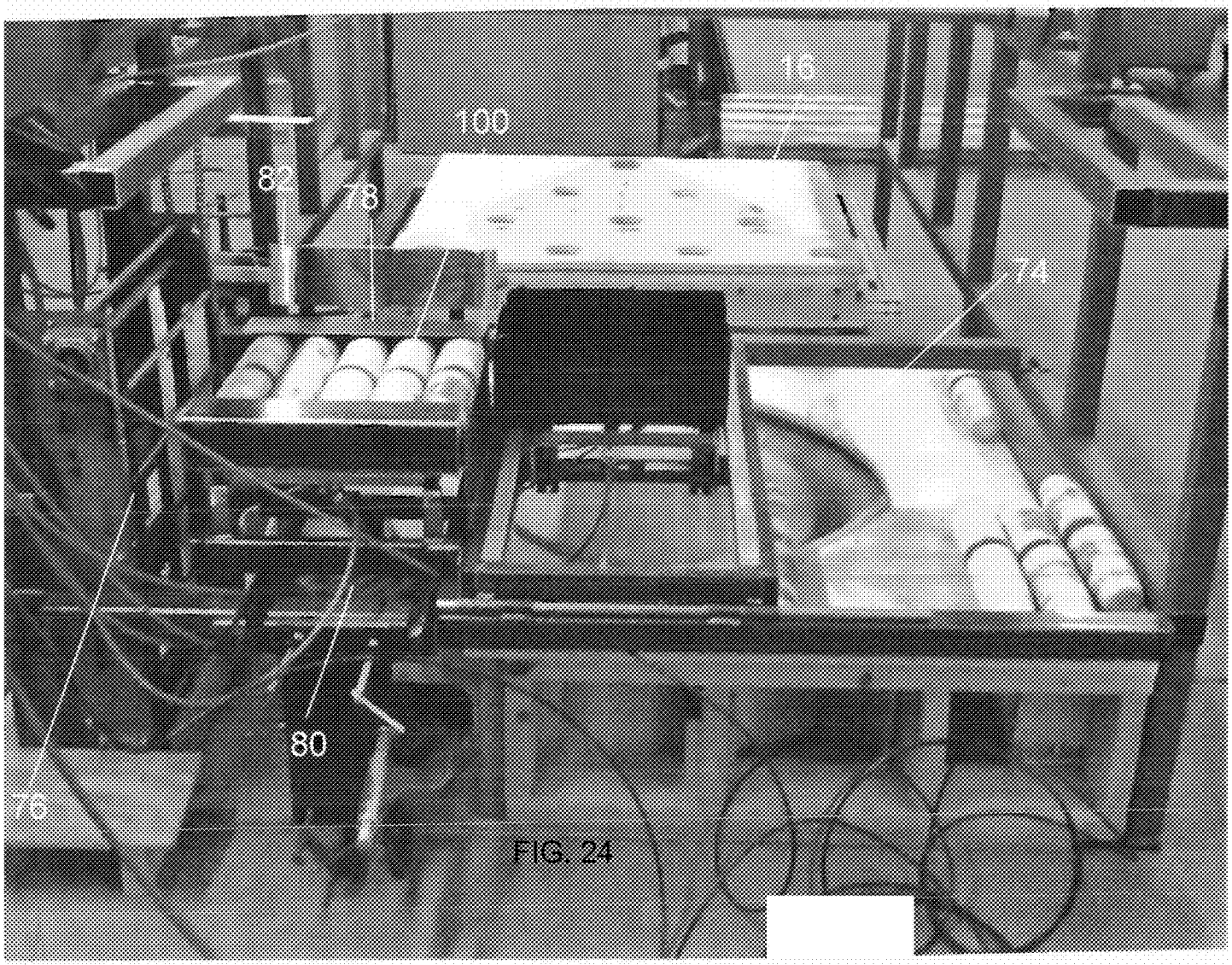
FIG. 24 is a further perspective view of the pin assembly and loading system.
Figure 25:
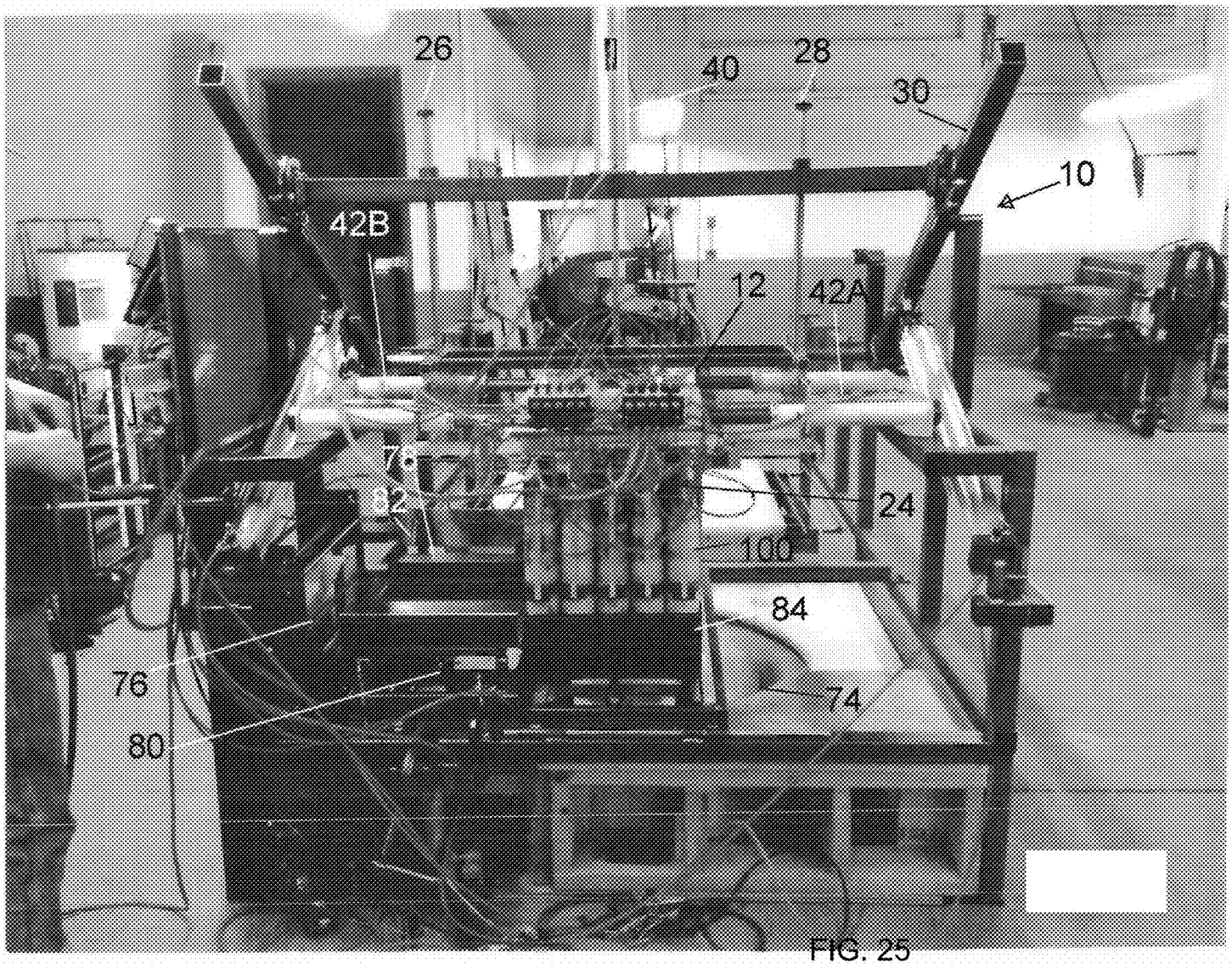
FIG. 25 is a perspective view of a bowling pin setting system with the pin assembly and loading system of FIG. 22 in use.

This embodiment of the bowling system 10 again includes a pin assembly and loading system as shown in FIGS. 22 through 24. In brief, the pin assembly and loading system receives bowling pins 100, such as pins 100 cleared or falling from the pin deck 16, assembles them into an organized format, and loads them into the pin setting array 12. With the pin setting array 12 loaded, the bowling pins 100 can be dispensed as described previously.

The pins 100 are received into a rotational hopper or turntable 74, such as by falling from the rear of the pin deck 16, such as in response to being struck or through a pivoting of the pin deck 16. The pins 100 are rotated within the rotating turntable 74 and dispensed to a conveyor 76, such as by the combined force of gravity and the centrifugal force of the rotating turntable 74. The pins 100 in this embodiment are disposed in horizontal orientations generally aligned with a longitudinal of the bowling pin deck 16 and, ultimately, the bowling alley 18. While the bowling pins 100 are in a horizontal position, the conveyor 76 carries the pins 100 vertically upward and feeds them in a side-by-side relationship to a cartridge or magazine 78, which could alternatively be referred to as a pivoting magazine 78. The loaded pins 100 are thus disposed in juxtaposition as shown in FIG. 23.

As the pivoting magazine 78 receives the pins 100, it too is disposed in what may be considered a horizontal orientation. The pivoting magazine 78 could receive and retain five bowling pins 100 with each loading corresponding to the number of pin retention mechanisms 24 in a given row of the pin setting array 12. Once a sensor detects that the pivoting magazine 78 is loaded with a predetermined number of pins 100, the conveyor 76 can be automatically stopped.

When the pivoting magazine 78 is fully loaded with bowling pins 100, the flipper 78 and the retained bowling pins 100 can be pivoted or flipped, such as by a lifting mechanism 80, from their horizontal orientation as shown, for example in FIG. 24, to a vertical orientation as shown, for example, in FIG. 23. Again, the lifting mechanism 80 could be of any effective type, including a pressurized fluidic cylinder, gearing, or some other mechanism. When vertically oriented, the pivoting magazine 78 and the bowling pins 100 retained thereby are in or can be brought into laterally alignment with a pin loading magazine 84. In this embodiment, there is a first, anterior pin loading magazine 84 and a second, posterior pin loading magazine 84. Once loaded, the pin loading magazines 84 can be or can be brought into alignment with the anterior and posterior rows of pin retention mechanisms 24 of the pin setting array 12.

With the pivoting magazine 78 aligned with a pin loading magazine 84, the pins 100 are fed from the pivoting magazine 78 and into the respective pin loading magazine 84. Here, the pins 100 are again slid laterally in series from the pivoting magazine 78 and into the respective pin loading magazine 84 by a push drive mechanism 82. As best seen in FIG. 24, the push drive mechanism 82 in this manifestation has a flat lateral portion that can face the several bowling pins 100 during application of the drive mechanism 82 and an orthogonal end portion that can engage and push the bowling pin 100 distal to the pin loading magazine 84 and, through that pin 100, all of the pins 100 toward and into the pin loading magazine 84.

With the anterior and posterior pin loading magazines 84 loaded with bowling pins 100 and the pin setting array 12 in a contracted configuration, the pin setting array 12 can be lowered into place to cause the bowling pins 100 to be received into the pin retention mechanisms 24. The pin retention mechanisms 24 can then engage the bowling pins 100 to travel with the pin retention mechanism 12 by actuation of the gripping fingers 70. When appropriate, the pin setting array 12, now retaining ten bowling pins 100, can be raised by the pressurized cylinder 40 and pivoted to its anterior position over the pin deck 16. The pin setting array 12 can then be lowered into position, and the pin retention mechanisms 24 can be adjusted to the expanded configuration. The bowling pins 100, now disposed in a proper equilateral triangle, can then be released and set on the pin deck 16, such as to permit the commencement of a new frame.

Under the construction summarized above, the bowling pin setting system can undertake what can be characterized as a pick and place process and a collect and organize process that begins in the rotational turntable. The schematic depiction of FIG. 6, which is not to scale and is not intended to show all components of the system 10, provides an illustrative flow chart outlining possible steps in such processes. The pick and place process is carried out by, among other system components, the pin setting array 12 of pin retention mechanisms 24 in cooperation with the pin loading magazines 84. The collect and organize process begins in the pin pit or rotational turntable 74.

One practice of the pick and place process could begin with the system or the bowler sending an electrical impulse from a signal actuator 88 to the computer 90 to activate a reset of bowling pins. The actuator 88 could, for example, comprise a sensor or sensors, a foot pedal, a button, or any other signal actuator 88. When the signal is received by the bowling system 10, the pin deck 16 can be pivoted upwardly, such as to a 45-degree angle from horizontal, to cause any dead wood bowling pins 100 to be dumped into the pit 74. In the embodiments of FIGS. 1 through 5 and 7 through 10, for instance, the gantry 15, which holds the pin setting array 12, simultaneously begins to move forward as the pin deck 16 begins to drop back into its home position parallel with the bowling lane 18. In the embodiment of FIGS. 18 through 20, the pivoting arms 30 can pivot forward. As the gantry 15 or the pivoting arms 30 begin to move forward to bring the pin setting array 12 anteriorly from behind the divider 36, the two rows of pin retention mechanisms 24 open into a perfect equilateral triangle. The gantry 15 travels to its end of stroke, and the array 12 of pin retention mechanisms 24 is lowered onto the pin deck 16. The fingers 70 release, and the pins 100 drop onto the pin deck 16. The pin setting array 12 can hesitate and then it begin to raise. As the pin setting array 12 is retracting, the pin retention mechanisms 24 that are in the expanded configuration are quickly brought into the contracted configuration to form two rows ready to pick the next set of pins 100. The gantry 15 holding the pin setting array 12 quickly retracts to a position removed from the space above the pin deck 16 to be above the pit 74 and its home position.

When a sensor indicates that the pin setting array 12 is in its home position, a sensor checks electronically to determine if a set of pins is waiting in the pin magazines 84 ready for picking. If there are, the pin setting array 12 is lowered onto the magazines 84, the fingers 70 close, and the pin setting array 12 is able to pick the next set of pins 100. The pin setting array 12 retracts to its home position with the ten pins 100 and waits for the next electrical impulse calling for a new set of pins 100.

The collect and organize process can, for instance, be triggered when a sensor detects that the pin magazines 84 do not contain a full set of pins 100. In this drawing, the referenced sensor or sensors can be of any effective type and can be incorporated in the referenced structure, physically connected, or not connected, or otherwise disposed to accomplish sensing. With that, the turntable 74 can be turned on, and the pin conveyor 76 can be activated. As the turntable 74 turns, the pins 100 are thrust off by the turntable 74 by centrifugal force. Bowling balls 102 can also be ejected from the turntable 74 by the same centrifugal force, and a motor, which can be separate, can send them back to the bowler via a ball return 94 as in FIG. 1.

The pins 100 land in a loader at the base of the pin conveyor 76 and the pins 100 are picked up there by the conveyor 76. The pins 100 are quickly exhausted from the conveyor 76 and loaded into the pivoting magazine 78 as a sensor counts the next five pins 100 being off loaded. Once the pivoting magazine 78 is loaded with five pins 100, an electrical impulse is sent to stop the motor 92 driving the turntable 74 and the conveyor 76. The pivoting magazine 78 is then commanded to rotate by operation of the lifting mechanism 80 by 90 degrees to a vertical orientation from its previous horizontal orientation. When the sensor determines that the pivoting magazine 78 is vertical, the push drive mechanism 82 pushes the five pins 100 into a waiting magazine 84 of the two magazines 84 that each hold five pins 100 thereby to form two parallel rows. The push drive mechanism 82 retracts immediately as the pivoting magazine 78 retracts to its horizontal position. The motor 92 can be re-engaged and the next magazine 84 is pushed into position to receive the next five pins 100.

After the first five pins 100 are loaded in to the first, posterior magazine 84, the magazine 84 can retract to its rearward, home position, and the second, anterior front magazine 84 moves to the loading position and waits for the next set of five pins 100 to be loaded into that magazine 84. When these five pins 100 are loaded, the second magazine 84 moves to its home position and waits. With both magazines 84 loaded, the sensor tells the computer 90 that the pin setting array 12, while in a contracted configuration, can pick the next set of pins 100. When the pin setting array 12 picks the pins 100 from the magazines 84, a signal can be sent to cause the posterior magazine 84 to adjust to the loading position to wait for the next five pins 100 from the pivoting magazine 78, and the loading cycle can continue.

It will be understood that the bowling system 10 could include additional or fewer components, functions, systems, or characteristics than those shown and described herein. Accordingly, although the foregoing components and arrangements of components may indeed be preferable and advantageous in achieving one or more objects of the invention, the bowling system 10 shall not be interpreted to require all of the foregoing components, to be limited to the specified components, or to be limited even to the positioning and configuration of individual components except as the claims might expressly specify.

Accordingly, with certain details and embodiments of the present invention for a bowling system 10 disclosed, it will be appreciated by one skilled in the art that numerous changes and additions could be made thereto without deviating from the spirit or scope of the invention. This is particularly true when one bears in mind that the presently preferred embodiments merely exemplify the broader invention revealed herein. Accordingly, it will be clear that those with major features of the invention in mind could craft embodiments that incorporate those major features while not incorporating all of the features included in the preferred embodiments.

Therefore, the following claims shall define the scope of protection to be afforded to the inventors. Those claims shall be deemed to include equivalent constructions insofar as they do not depart from the spirit and scope of the invention. It must be further noted that a plurality of the following claims may express certain elements as means for performing a specific function, at times without the recital of structure or material. As the law demands, any such claims shall be construed to cover not only the corresponding structure and material expressly described in this specification but also all equivalents thereof.

We claim as deserving the protection of Letters Patent:

1. A bowling pin setting system for setting Candlepin bowling pins on a pin deck of a Candlepin bowling lane, the bowling pin setting system comprising:

a. a pin deck for the placement of bowling pins in a predetermined array, the bowling pins placed in the predetermined array representing the targets for a bowling ball;

b. a rotational turntable and at least one pivoting magazine positioned to a rear of the pin deck such that pins from the pin deck collect on the rotational turntable and dispense to a conveyor means;

c. conveyor means for receiving a plurality of bowling pins, in a horizontal orientation, from the rotational turntable and feeding them to the pivoting magazine;

d. said pivoting magazine comprising a frame capable of receiving the plurality of pins from the conveyor in an adjacent and horizontal orientation, and pivoting about an axis, through the action of a lifting mechanism means to orient the received pins in an adjacent and vertical orientation;

e. a means to bring the at least one pivoting magazine into alignment and adjacent with at least one pin loading magazine;

f. a push drive mechanism means for laterally sliding in series the pins from the at least one pivoting magazine to at least one pin loading magazine and;

g. a pin setting array having pin retention mechanisms and a means for lowering it in a contracted configuration to receive the pins from at least one pin loading mechanism and raising it to move the pins over the in deck, lower and adjust the pins to an expanded configuration and release them.

2. The bowling pin setting system of claim 1 wherein the pin setting array is slideably engaged with a track system via a platform and gantry arrangement, to move longitudinally from a posterior position in which the pin setting array is contracted, to an anterior position in which the pin setting array is expanded to position the bowling pins in the predetermined array.

3. The bowling pin setting system of claim 1 wherein the pin deck is pivotable and has an anterior end and a posterior end, the pivotable pin deck being pivotable from a flat position to a raised position about a lateral axis disposed at or adjacent to the posterior end of the pin deck.

* * * * *